US007308741B1

(12) United States Patent
Rydberg et al.

(10) Patent No.: US 7,308,741 B1
(45) Date of Patent: Dec. 18, 2007

(54) HUGGABLE CREMATED REMAINS STORAGE SYSTEMS

(76) Inventors: Mary F. Rydberg, 9625 N. 132nd Pl., Scottsdale, AZ (US) 85259; Sharon M. Robinson, 12635 N. La Montana Dr., #10, Fountain Hills, AZ (US) 85268

( * ) Notice: Subject to any disclaimer, the term of this patent is extended or adjusted under 35 U.S.C. 154(b) by 0 days.

(21) Appl. No.: 11/558,830

(22) Filed: Nov. 10, 2006

Related U.S. Application Data

(60) Provisional application No. 60/735,345, filed on Nov. 12, 2005.

(51) Int. Cl.
*A61G 17/00* (2006.01)

(52) U.S. Cl. ..... 27/1

(58) Field of Classification Search ..... 27/1; D99/5; 446/73; 705/1, 26, 27
See application file for complete search history.

(56) References Cited

U.S. PATENT DOCUMENTS 232,782 A 9/1880 Townsend
4,648,162 A * 3/1987 Daino ..... 27/1
5,606,785 A * 3/1997 Shelberg et al. ..... 27/19
6,324,737 B1 * 12/2001 Chamness et al. ..... 27/2
6,763,558 B1 * 7/2004 Mytych ..... 27/2
6,785,938 B1 9/2004 Johansen, Jr.
7,043,803 B2 * 5/2006 Chen ..... 27/1
2002/0082855 A1 * 6/2002 Dickey et al. ..... 705/1
2003/0004740 A1 * 1/2003 Dickey et al. ..... 705/1
2006/0059669 A1 * 3/2006 Rose ..... 27/1

* cited by examiner

*Primary Examiner*—William L. Miller
(74) *Attorney, Agent, or Firm*—Stoneman Volk Patent Group; Martin L. Stoneman; Michael D. Volk, Jr.

(57) ABSTRACT

A system for storing cremated remains in one or more holders that may be comfortably held by an individual. The present invention comprises a "plush container", such as a stuffed animal, and further comprises ornamental symbols or similar features for ornamentally symbolizing at least one characteristic of the entity associated with the cremated remains. For example, the system may comprise a symbolic depiction of a vocation or avocation associated with the individual's life. Preferred embodiments also comprise user customizable elements that include photographic and similar graphic imprinting.

25 Claims, 13 Drawing Sheets

HUGGABLE CREMATED REMAINS STORAGE SYSTEMS

CROSS-REFERENCE TO RELATED APPLICATION

The present application is related to and claims priority from prior provisional application Ser. No. 60/735,345, filed Nov. 12, 2005, entitled "HUGGABLE CREMATED REMAINS STORAGE SYSTEMS", the content of which is incorporated herein by this reference and is not admitted to be prior art with respect to the present invention by the mention in this cross-reference section.

BACKGROUND

This invention relates to providing systems for improved cremated remains storage. More particularly, this invention relates to providing systems for storing cremated remains in one or more holders that may be comfortably held by an individual.

No longer does much of the human population live, work, and die in a single geographic location. This shift toward migratory lifestyles directly contributes to the need for mobility options for loved ones both human and pet after their passing.

The above-described mobility of today's population combined with the simplicity and dignity of the cremation process has resulted in an increase its popularity worldwide. The Cremation Association of North America (CANA) has projected that by 2010 the number of cremations in the United States will rise to over 35% of all internment arrangements.

Cremation is a process of reducing the body of a deceased individual or pet to small bone fragments using high heat and flame. These fragments are further reduced in size through a mechanical process. Even after mechanical processing, the remains seldom comprise a smooth and uniform consistency. After preparation, the resulting materials are placed in a temporary container that is suitable for transport. Depending upon the size of the body, there are typically three to nine pounds of human cremated remains.

In comparison to the human death care industry, the death care industry for pets has become increasingly diverse. More pet owners are seeking new ways to memorialize their animals after the death of the pet. Pet cremations are becoming an accepted method of internment and with today's mobile society, many pet owners chose this type of internment for their pet so that they are able to take their loved ones with them when they relocate.

Currently, those who have lost a loved one, who have chosen cremation as the method of internment, and wish to keep their loved one close, have very few internment and memorial options. Currently, no system exists for providing one or more cushioned housings for holding human or pet cremated remains in an arrangement that may be comfortably held by an individual.

OBJECTS AND FEATURES OF THE INVENTION

A primary object and feature of the present invention is to provide a system to address the above-described needs.

It is a further object and feature of the present invention to provide such a system assisting in comforting those who have lost a loved one by providing one or more cushioned housings for holding the cremated remains in an arrangement that may be comfortably held by an individual.

It is another object and feature of the present invention to provide such a system offering a full encasement of such cremated remains within a resilient padding.

It is a further object and feature of the present invention to provide such a system comprising an ornamental symbol or similar feature for ornamentally symbolizing at least one characteristic of the entity associated with the cremated remains. For example, the system may comprise a symbolic depiction of a vocation or avocation associated with the individual's life.

It is another object and feature of the present invention to provide such a system providing a retaining feature for retaining at least one jewelry item adjacent such a cushioned housing.

It is a further object and feature of the present invention to provide such a system comprising a housing in the form of an animal shape. It is another object and feature of the present invention to provide such a system comprising a housing in the form of a pillow. It is yet another object and feature of the present invention to provide such a system comprising a housing in the form of a pillow having a detachable panel that can be custom imprinted with a graphic image.

It is a further object and feature of the present invention to provide such a system in the form of a kit.

It is another object and feature of the present invention to provide unique methods of wholesale and retail distribution.

It is a further object and feature of the present invention to provide a method of customizing the above-described system.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a system related to the holding of cremated remains comprising: container means for containing the cremated remains; cushioned housing means for housing such container means; pocket means for pocketing such container means within such cushioned housing means; closure means for closing such pocket means; and void filler means for filling voids surrounding such container means within such pocket means; wherein such filler means comprises cushioner means for cushioning such container means while such container means is pocketed within such pocket means.

Moreover, it provides such a system wherein such cushioned housing means comprises ornamental symbol means for ornamentally symbolizing at least one characteristic of the entity associated with the cremated remains. Additionally, it provides such a system wherein such cushioned housing means comprises animal shape means for providing to such cushioned housing means at least one animal shape. In addition, it provides such a system wherein such cushioned housing means comprises vocation symbol means for ornamentally symbolizing at least one human vocation. In addition, it provides such a system wherein such cushioned housing means comprises avocation symbol means for ornamentally symbolizing at least one human avocation. Moreover, it provides such a system wherein such cushioned housing means comprises graphic support means for supporting at least one graphic image. Further, it provides such a system further comprising jewelry retainer means for retaining at least one jewelry item adjacent such cushioned housing means.

In accordance with another preferred embodiment hereof, this invention provides a system related to the holding of cremated remains comprising: at least one container adapted to contain the cremated remains; at least one cushioned housing adapted to house such at least one container; at least one pocket adapted to hold such at least one container within such at least one cushioned housing; at least one closure adapted to close such at least one pocket; and at least one void filler adapted to fill at least one void surrounding such at least one container within such at least one pocket; wherein such at least one void filler comprises at least one cushioner adapted to cushion such at least one container while held within such at least one pocket. Moreover, it provides such a system wherein such at least one cushioned housing comprises at least one ornamental symbol adapted to ornamentally symbolize at least one characteristic of at least one entity associated with the cremated remains.

Additionally, it provides such a system wherein such at least one cushioned housing comprises at least one animal shape. Also, it provides such a system wherein such at least one animal shape comprises at least one depiction substantially resembling animals classified within Family Ursidae. In addition, it provides such a system wherein such at least one animal shape comprises at least one depiction substantially resembling animals classified within Family Canidae. And, it provides such a system wherein such at least one animal shape comprises at least one depiction substantially resembling animals classified within Family Felidae. Further, it provides such a system wherein such at least one cushioned housing comprises at least one vocation symbol to ornamentally symbolize at least one human vocation. Even further, it provides such a system wherein such at least one vocation symbol comprises at least one wearable article applied to such at least one cushioned housing.

Moreover, it provides such a system wherein such at least one cushioned housing comprises at least one avocation symbol to ornamentally symbolize at least one human avocation. Additionally, it provides such a system wherein such at least one avocation symbol comprises at least one wearable article applied to such at least one cushioned housing. Also, it provides such a system wherein: such at least one cushioned housing comprises at least one pillow; and such at least one pillow comprises at least one substantially flexible outer membrane substantially enclosing at least one substantially resilient filling material. In addition, it provides such a system wherein such at least one pillow comprises at least one graphic supporter adapted to support at least one graphic image. And, it provides such a system wherein such at least one graphic supporter comprises at least one substantially flexible panel. Further, it provides such a system wherein such at least one substantially flexible panel comprises at least one removable fastener adapted to removably fasten such at least one substantially flexible panel to such at least one substantially flexible outer membrane.

Even further, it provides such a system wherein such at least one substantially flexible panel comprises at least one fabric. Moreover, it provides such a system further comprising at least one jewelry retainer adapted to retain at least one jewelry item adjacent to such at least one cushioned housing. Additionally, it provides such a system further comprising at least one jewelry item. Also, it provides such a system wherein such at least one jewelry item comprises at least one disk-shaped portion. In addition, it provides such a system wherein such at least one jewelry item comprises at least one heart-shaped portion. And, it provides such a system wherein such at least one jewelry item comprises at least one bone-shaped portion. Further, it provides such a system wherein such at least one closure comprises at least one zipper.

In accordance with another preferred embodiment hereof, this invention provides a kit system, related to the holding of cremated remains, comprising at least one kit comprising: at least one container adapted to contain the cremated remains; at least one cushioned housing adapted to house such at least one container comprising at least one pocket adapted to hold such at least one container within such at least one cushioned housing, and at least one closure adapted to close such at least one pocket; at least one void filler adapted to fill at least one void surrounding such at least one container within such at least one pocket wherein such at least one void filler comprises at least one cushioner adapted to cushion such at least one container while held within such at least one pocket; and at least one set of user instructions. Even further, it provides such a kit system further comprising at least one jewelry item. Moreover, it provides such a kit system further comprising at least one plurality of such at least one kits. Additionally, it provides such a kit system wherein each such at least one cushioned housing of such at least one plurality of such at least one kits is substantially identical. Also, it provides such a kit system wherein each such at least one cushioned housing of such at least one plurality of such at least one kits is substantially unique.

In accordance with another preferred embodiment hereof, this invention provides a kit system related to the holding of cremated remains comprising: at least one container adapted to contain the cremated remains; at least one pillow comprising at least one substantially flexible outer membrane substantially enclosing at least one substantially resilient filling material, at least one pocket adapted to hold such at least one container within such at least one pillow, and at least one closure adapted to close such at least one pocket; at least one void filler adapted to fill at least one void surrounding such at least one container within such at least one pocket wherein such at least one void filler comprises at least one cushioner adapted to cushion such at least one container while held within such at least one pocket; at least one graphic supporter adapted to support at least one graphic image; and at least one set of user instructions adapted to provide at least one instruction related to the application of such at least one graphic image to such at least one graphic supporter; wherein such at least one graphic supporter comprises at least one substantially flexible panel comprising at least one removable fastener adapted to removably fasten such at least one substantially flexible panel to such at least one substantially flexible outer membrane. In addition, it provides such a kit system further comprising at least one jewelry item.

In accordance with another preferred embodiment hereof, this invention provides a method, related to customizable cremated remains holders, comprising the steps of: providing for the manufacture of customizable cremated remains holder kit systems comprising at least one customizable cremated remains holder; offering for sale such customizable cremated remains holder kit systems; accepting at least one custom order for such customizable cremated remains holder kit systems; providing for acceptance of orders and payment from at least one individual for such customizable cremated remains holder kit systems; providing for shipping such ordered customizable cremated remains holder kit systems to such at least one individual; and providing at least one instruction set instructing at least one method of customizing such at least one customizable cremated remains holder. And, it provides such a method wherein such step of offering is performed through at least one site comprising an Internet site operated in conjunction with at least one website server.

In accordance with another preferred embodiment hereof, this invention provides a method, related to the holding of cremated remains comprising the steps of: receiving at least one cremated remains holder comprising at least one removable graphics supporting panel; removing such at least one removable graphics supporting panel; imprinting such at least one removable graphics supporting panel with at least one graphic image; and installing such at least one removable graphics supporting panel on such at least one cremated remains holder; wherein such at least one cremated remains holder comprises at least one substantially flexible outer membrane substantially enclosing at least one substantially resilient filling material.

DETAILED DESCRIPTION OF THE BEST MODES AND PREFERRED EMBODIMENTS OF THE INVENTION

Figure 1:
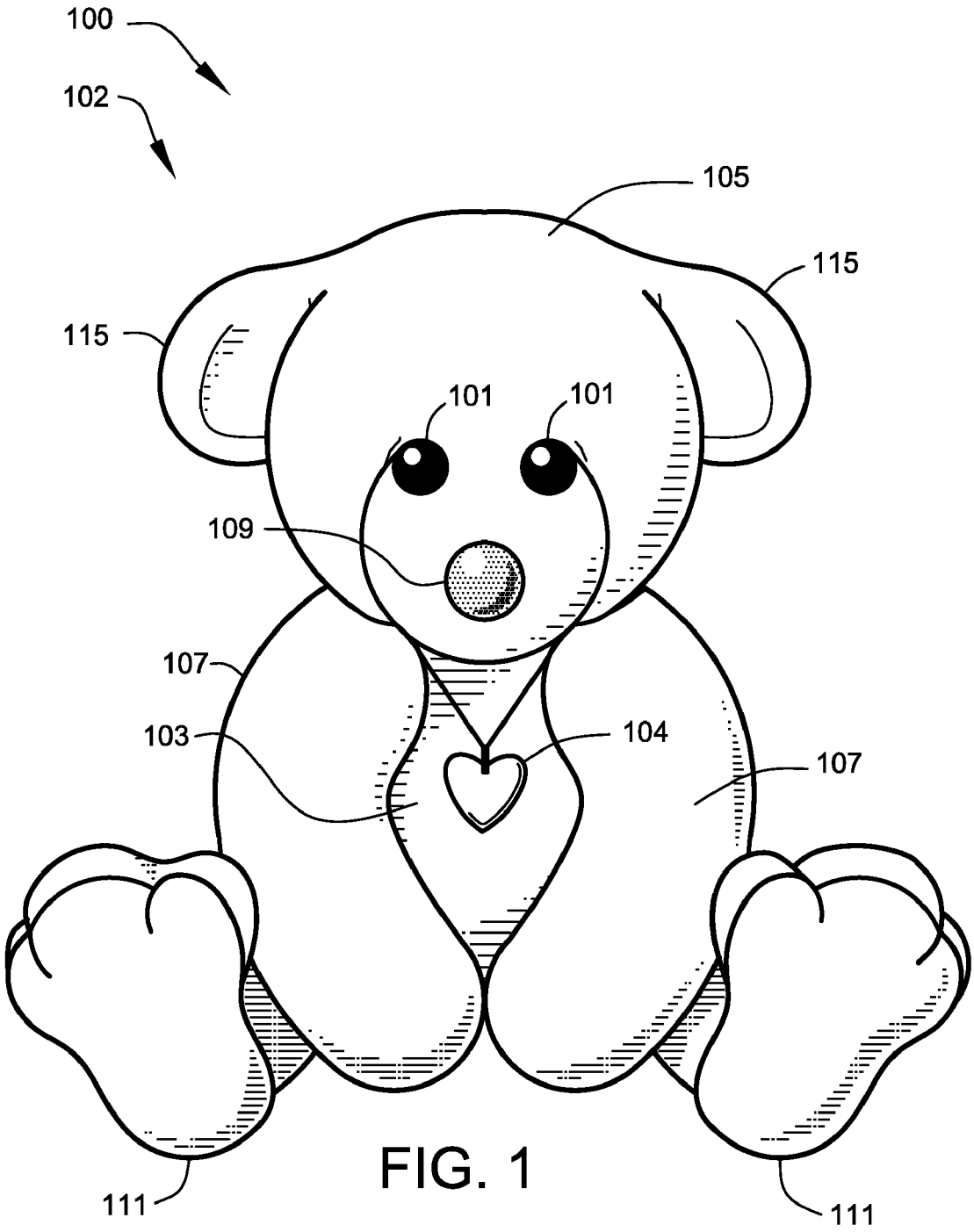
FIG. 1 shows a front view illustrating a soft cremated remains holder, of a huggable cremated remains storage system, according to a preferred embodiment of the present invention.

FIG. 1 shows a front view illustrating soft cremated remains holder 102, of huggable cremated remains storage system 100, according to a preferred embodiment of the present invention. Huggable cremated remains storage system 100 preferably comprises a group of closely related embodiments each adapted to hold the cremated remains of a human or pet. The basic need satisfied by the present invention includes providing a mobile, affordable, and emotionally satisfying option for the internment of a deceased loved one, both human and pet. The preferred embodiments of huggable cremated remains storage system 100 each comprise at least one "soft-sided" container for the cremated remains that is easily transportable and structured to permit comfortable cuddling/holding of the container assembly, as shown.

Preferably, soft cremated remains holder 102 comprises a pleasing form, most preferably, a form having a symbolic or emotional significance to the user. Preferably, soft cremated remains holder 102 comprises a "plush figure", more preferably a stylized depiction of an animal, most preferably resembling an animal classified mainly within Family Ursidae but including koala bears, Pandas, etc. (more commonly known as a bear or in the area of plush figures, a teddy bear). Preferably, soft cremated remains holder 102 comprises a body portion 103, head portion 105, arms 107, and legs 111, as shown. Preferably, head portion 105 comprises customary head features such as eyes 101, nose 109 and ears 115, as shown. Upon reading the teachings of this specification, those of ordinary skill in the art will now understand that, under appropriate circumstances, considering such issues as cost, market demand, specific species, artistic license, etc., other physical features, depictions, and structural arrangements, such as, for example, fur patterning, patches, buttons, claws/nails, etc., may suffice.

Figure 2:
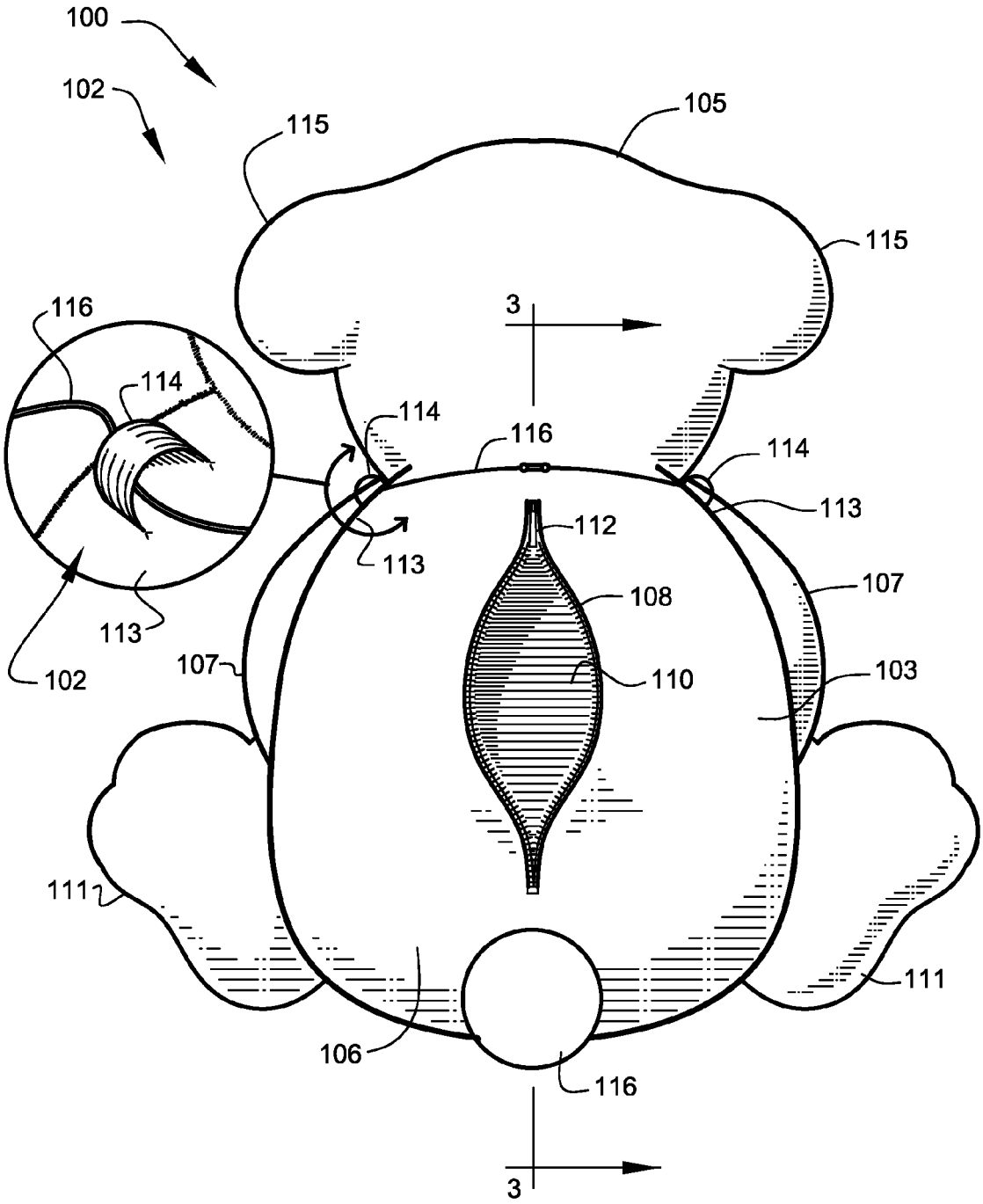
FIG. 2 shows a rear view of the soft cremated remains holder of FIG. 1.
Figure 3:
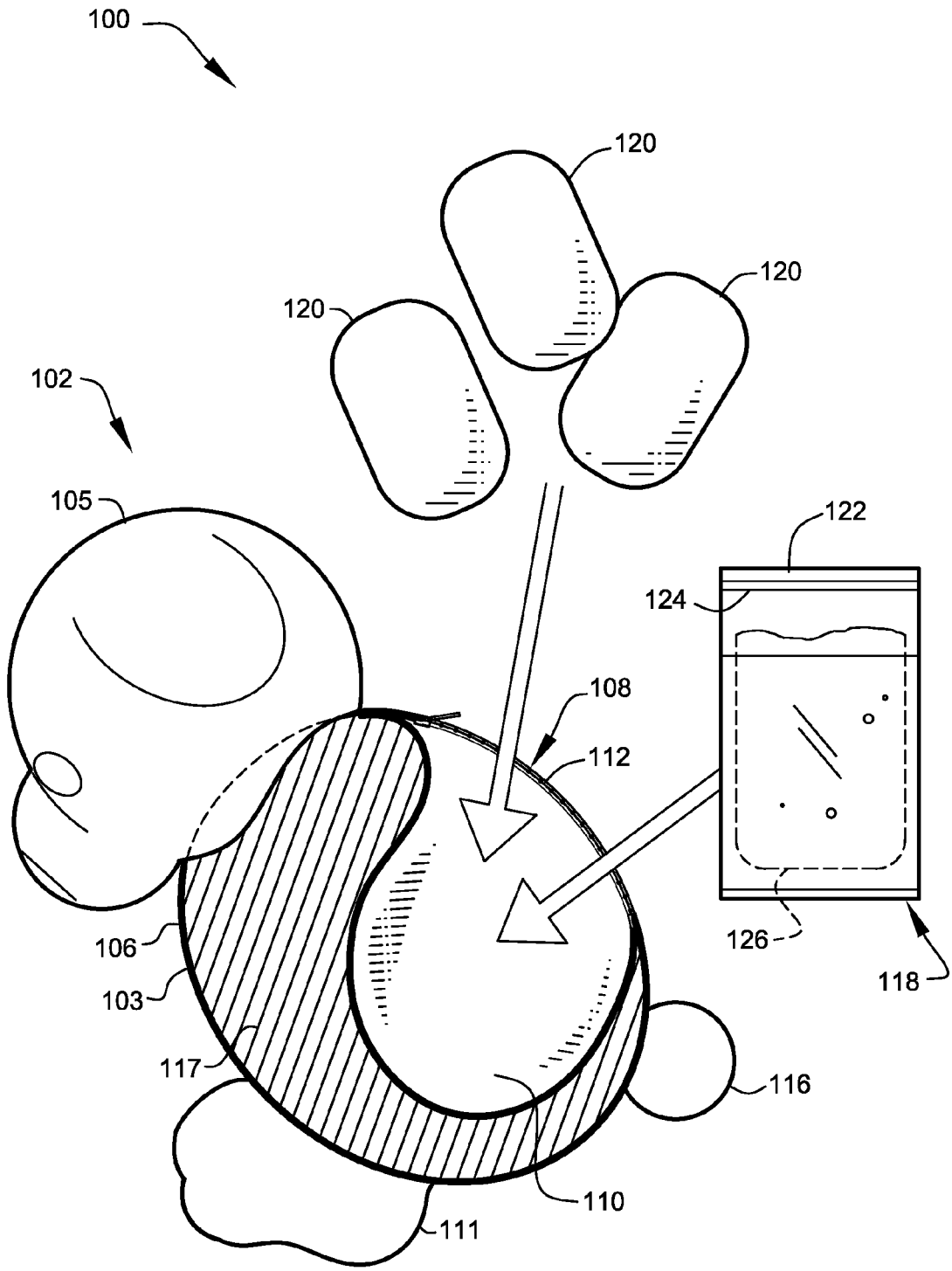
FIG. 3 shows a sectional view, through the section 3-3 of FIG. 2, illustrating preferred component arrangements of the soft cremated remains holder, according to the preferred embodiment of FIG. 1.

Preferably, soft cremated remains holder 102 (at least embodying herein cushioned housing means for housing such container means, and at least embodying herein at least one cushioned housing) is constructed from a substantially flexible outer membrane 106 surrounding a resilient core material (see FIG. 3). Preferably, flexible outer membrane 106 is constructed from a fabric, more preferably a fabric having a pile or napped surface, with fabrics such as velvet, velour, or synthetic fur being preferred. Soft cremated remains holder 102 is preferably assembled by mechanical seaming processes using an appropriately compatible thread. Upon reading the teachings of this specification, those of ordinary skill in the art will now understand that, under appropriate circumstances, considering such issues as cost, market demand, pattern, fabric type, etc., other construction arrangements, such as, for example, hand-stitching, the use of glues, chemical bonding agents, thermal/ultrasonic bonding, etc., may suffice. Preferably, soft cremated remains holder 102 is further adapted to support one or more personalizing accessories such as charm 104, as further described in FIG. 2.

FIG. 2 shows a rear view of the soft cremated remains holder 102 of FIG. 1. Preferably, the rear portion of soft cremated remains holder 102 comprises access 108, as shown. Preferably, access 108 comprises a slot or similar opening through which an interiorly disposed pocket 110 is accessed. Preferably, pocket 110 is adapted to establish a compartment sized to accept substantially the entire volume of cremated remains (at least embodying herein pocket means for pocketing such container means within such cushioned housing means). For example, soft cremated-remains holder 102 is adapted to hold a minimum of about 200 cubic inches human cremated remains in a protectively cushioned arrangement.

Preferably, access 108 comprises a closure means for closing and sealing access 108 to assist in retaining the contents of pocket 110 interior of soft cremated remains holder 102. In a highly preferred embodiment of the present invention, the closure means comprises zipper 112, as shown (at least embodying herein closure means for closing such pocket means). Upon reading the teachings of this specification, those of ordinary skill in the art will now understand that, under appropriate circumstances, considering such issues as cost, market demand, body design, weight of cremated remains, etc., other closure arrangements, such as, for example, lacing, hook-and-loop fasteners, flaps, elastic closures, draw strings, etc., may suffice.

Preferably, the upper "shoulder" areas 113 of soft cremated remains holder 102 comprise a pair of fixed accessory loops 114 through which a suspending element of charm 104 may be passed, as shown. For example, charm 104 is secured to soft cremated remains holder 102 by passing the chain portion 116 of charm 104 through accessory loops 114, as shown. Preferably, accessory loops 114 (at least embodying herein at least one jewelry retainer adapted into retain at least one jewelry item adjacent such at least one cushioned housing) comprise a substantially flexible material, preferably a fabric ribbon, permanently joined to the exterior of body portion 103, as shown. Preferably, accessory loops 114 are mechanically sewn to outer membrane 106, as shown. Additional preferred physical features visible in FIG. 2 include tail 116, preferably of a corresponding soft construction, as shown.

FIG. 3 shows a sectional view, through the section 3-3 of FIG. 2, illustrating preferred component arrangements of soft cremated remains holder 102, according to the preferred embodiment of FIG. 1. FIG. 3 further illustrates the additional preferred components comprising huggable cremated remains storage system 100. These preferred components include flexible storage container 118 and a plurality of void-filling cushions 120, as shown.

Preferably, flexible storage container 118 comprises a sealable bag having a capacity suitable for holding substantially the entire volume of cremated remains (at least embodying herein container means for containing the cremated remains, and at least embodying herein at least one container). As previously stated, the capacity required for human remains averages between about 200 to 230 cubic inches. Preferably, the capacity of flexible storage container 118 is appropriately sized to match the volume of cremated remains to be stored. The flexible storage container 118 capacities for nonhuman (pet) cremated remains are preferably based on the size of the pet and vary widely between breeds. Preferably, all embodiments of flexible storage container 118 are constructed from suitably durable materials, preferably a plastic, most preferably a sheet plastic having a thickness of about 6 mil. Preferably, flexible storage container 118 comprises a plastic selected from the family of polyolefins (Polyethylene, Polypropylene or Ethylene-Olefin Copolymers). Alternately, flexible storage container 118 is preferably fabricated of heavy-duty vinyl/laminated polyester fabric. Preferably, the plastic membrane of flexible storage container 118 is configured to form a sealable bag with side and bottom seams permanently sealed to prevent leakage. Preferably, flexible storage container 118 comprises a user sealable opening 122, as shown. Preferably, user sealable opening 122 comprises adhesive strip 124 that when engaged, closes and seals flexible storage container 118 in a substantially permanent manner. Thus, in preparing the cremated remains 126 for internment within soft cremated-remains holder 102, the user transfers the cremated remains 126 within a temporary storage container to flexible storage container 118 and secures sealable opening 122 using adhesive strip 124. Upon reading the teachings of this specification, those of ordinary skill in the art will now understand that, under appropriate circumstances, considering such issues as intended use, safety, cost, market demand, traditions of observance, etc., other sealing arrangements, such as, for example, the use of resealable openings, openings comprising threaded caps, roll-type closure seals, etc., may suffice. Furthermore, those of ordinary skill in the art will now understand that, under appropriate circumstances, considering such issues as user preference, scope of crematory services, etc., alternate sealing arrangements, performed apart from the user, such as, for example, pre-sealing of cremated remains within an appropriate storage container, by a crematory staff member, followed by delivery to family members, etc., may suffice.

Preferably, head portion 105, arms 107, legs 111, and body portion 103 comprise an assembly of fabric panels (outer membrane 106) inclosing resilient core 117, as shown. Preferably, the fabric panels used in the assembly of soft cremated-remains holder 102 are produced from physical or electronic patterns using appropriate textile product manufacturing methods. Resilient core 117 preferably comprises a lightweight synthetic fiber filling, preferably a commercially available filling material, with polyester fill (marketed under the name fiberfill) being most preferred. Preferably, the individual panels comprising outer membrane 106 are mechanically sewn to permanently encapsulate resilient core 117, as shown. Upon reading the teachings of this specification, those of ordinary skill in the art will now understand that, under appropriate circumstances, considering such issues as safety, intended use, cost, market demand, etc., other fill arrangements, such as, for example, resilient expanded foams, synthetic or natural pellets (e.g., as in "beanbags"), molded resilient foams, etc., may suffice.

Preferably, on securing cremated remains 126 within flexible storage container 118, cremated remains 126 is positioned within pocket 110, as shown. Preferably, pocket 110 is accessed through access 108 by positioning zipper 112 in an open configuration, as shown. Preferably, pocket 110 comprises a substantially continuous flexible compartment formed within the interior of body portion 103, as shown. Preferably, pocket 110 comprises at least one woven fabric material. Preferably, peripheral opening of pocket 110 is joined to the interior side of access 108, preferably by mechanical sewing to outer membrane 106, concurrently with the attachment of zipper 112. Upon reading the teachings of this specification, those of ordinary skill in the art will now understand that, under appropriate circumstances, considering such issues as preferred design, preference of patternmaking, etc., other construction arrangements, such as, for example, forming the interior pocket and outer membrane from a continuous fabric panel, combining the function of the flexible storage container with the pocket alone, including within the pocket additional restraining features to restrain or position the flexible storage container within the pocket, etc., may suffice.

As previously described, the composition of most cremated remains is not uniform. Typically, the consistency of cremated remains 126 is such that the inconsistency of composition is readily discernible during handling and manual manipulation. Huggable cremated remains storage system 100 resolves this issue by providing void-filling cushions 120 adapted to cushion cremated remains 126.

Preferably, each void-filling cushion 120 comprises a substantially flexible membrane enveloping a resilient core. Most preferably, each void-filling cushion 120 (at least embodying herein void filler means for filling voids surrounding such container means within such pocket means, and at least embodying herein at least one void filler adapted to fill at least one void surrounding such container means within such pocket means) comprises an outer fabric surrounding a core of resilient polyester fill (at least embodying herein wherein such at least one void filler comprises at least one cushioner adapted to cushion such at least one container while held within such at least one pocket). Preferably, the outer fabric of void-filling cushion 120 is mechanically sewn to permanently encapsulate a resilient core material, as shown. Upon reading the teachings of this specification, those of ordinary skill in the art will now understand that, under appropriate circumstances, considering such issues as intended use, cost, etc., other fill arrangements, such as, for example, resilient expanded foams, synthetic or natural pellets, molded resilient foams, etc., may suffice.

Figure 4:
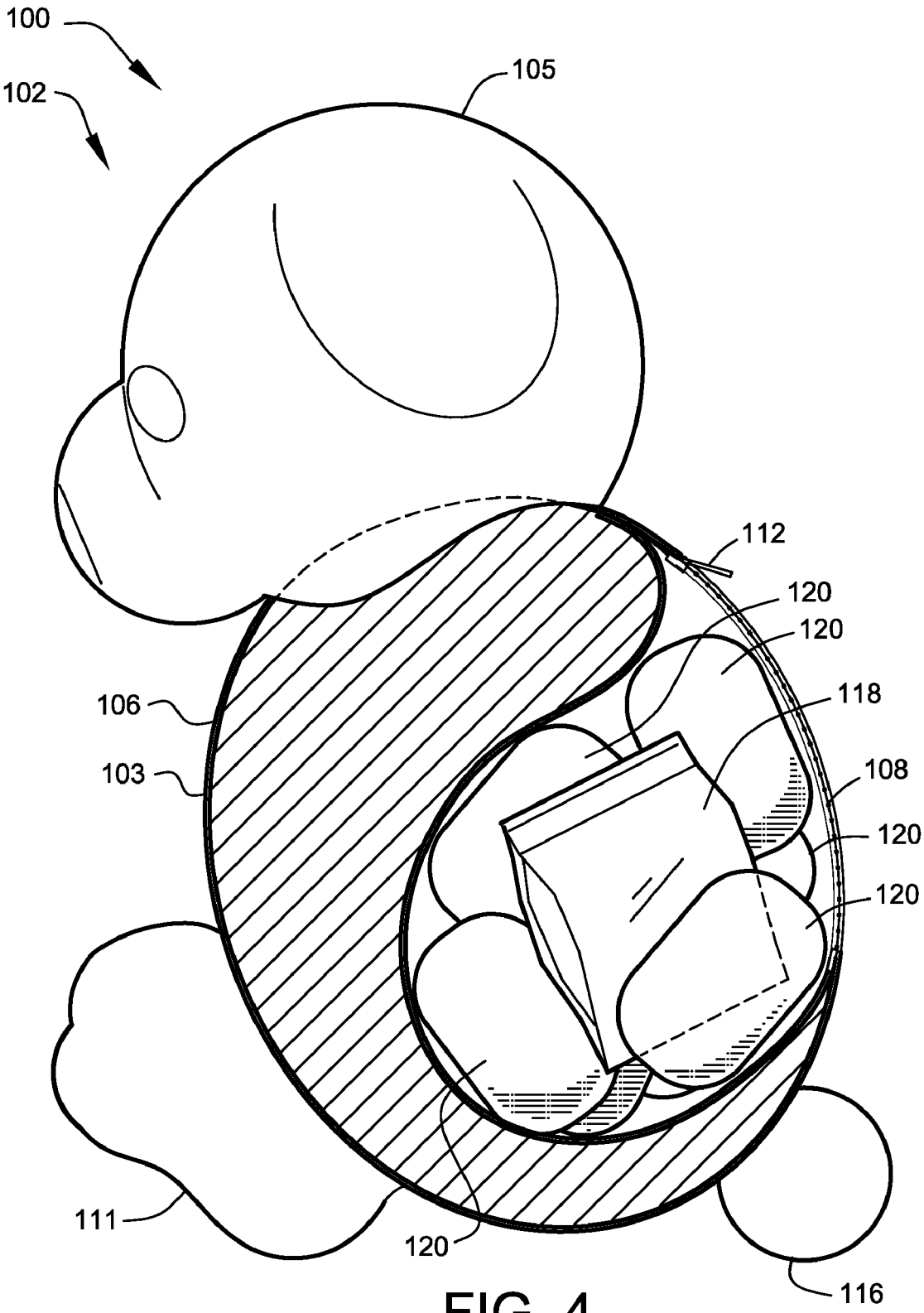
FIG. 4 shows a sectional view, through the section 3-3 of FIG. 2, illustrating preferred interior component arrangements of the soft cremated remains holder, according to the preferred embodiment of FIG. 1.

FIG. 4 shows a sectional view, through the section 3-3 of FIG. 2, illustrating assembled interior component arrangements of soft cremated remains holder 102, according to the preferred embodiment of FIG. 1. Preferably, as described above, cremated remains 126 are protectively held in a soft enveloping layer of void-filling cushions 120, as shown. Preferably, assemblage of the interior components is undertaken by the user and is preferably based on user preference, volume of cremated remains 126, and physical configuration soft cremated-remains holder 102.

On installing cremated remains 126 and void-filling cushions 120 within pocket 110, the user positions and arranges the contents of pocket 110 to the preference and satisfaction the user. Preferably, access 108 is again sealed by closing zipper 112, as shown. Preferably, soft cremated-remains holder 102 is thus configured by the user to allow comfortable holding (hugging) and manual manipulation, even with substantially the entire volume of cremated remains 126 securely interned therewithin.

Figure 5:
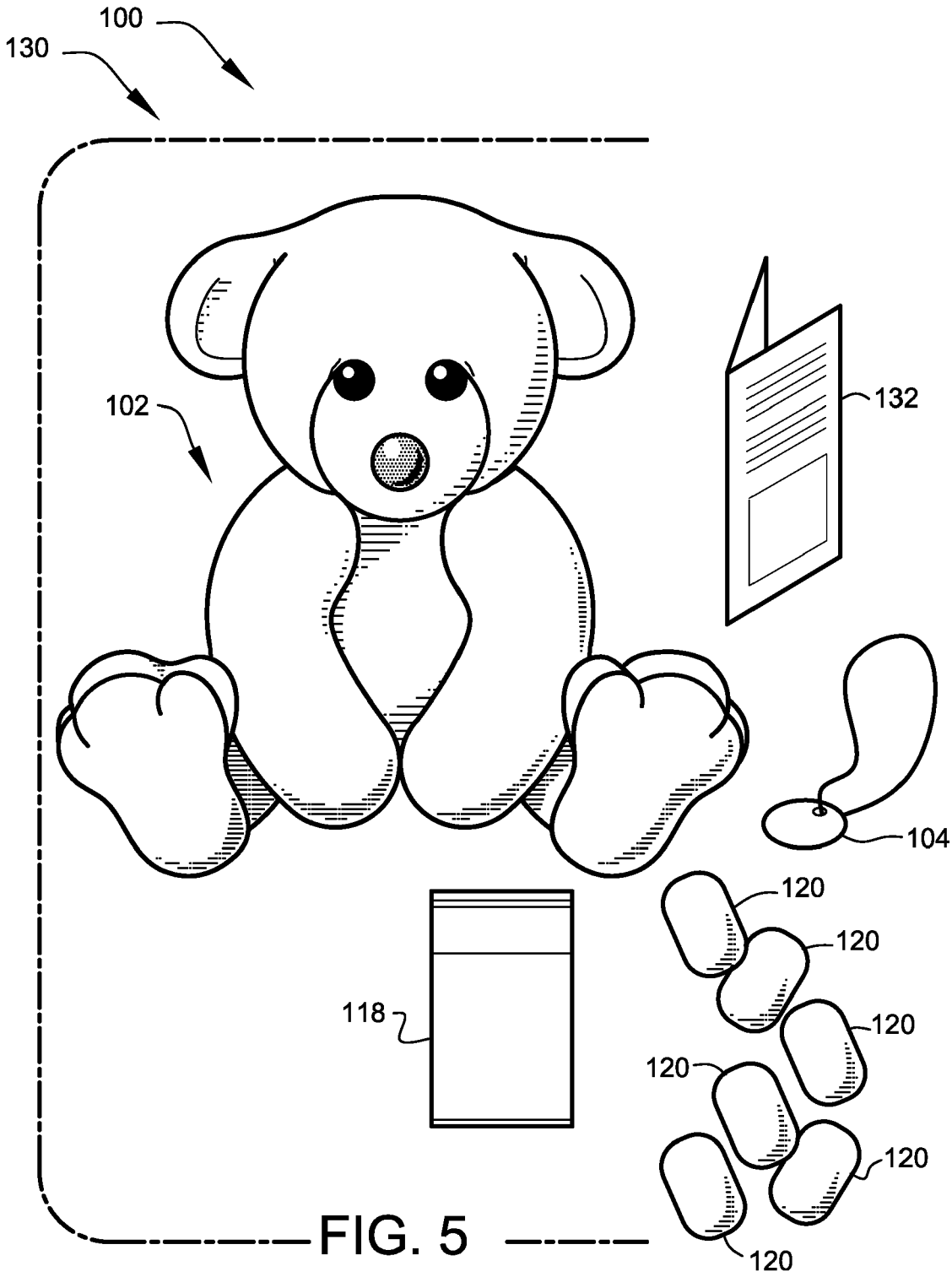
FIG. 5 shows a diagrammatic representation illustrating a kit of the huggable cremated remains storage system, according to another preferred embodiment of the present invention.

FIG. 5 shows a diagrammatic representation illustrating kit 130 of huggable cremated remains storage system 100, according to another preferred embodiment of the present invention. Preferred embodiments of huggable cremated remains storage system 100 are preferably arranged to comprise user-assembled kits, as shown. Preferably, example kit 130 comprises the essential components needed to intern cremated remains 126 within huggable cremated remains storage system 100. These preferred components minimally comprise soft cremated-remains holder 102, flexible storage container 118, a quantity of void-filling cushions 120, and at least one set of user assembly instructions 132, as shown. In addition, preferred embodiments of kit 130 comprise a customizing accessory, preferably comprising charm 104, as shown. As previously indicated, the capacity of flexible storage container 118 as well as the number of void-filling cushions 120 are preferably selected based on the quantity of cremated remains 126 to be interned. For example, a user may be assisted in selecting an appropriately configured kit by referring to a pre-established list of available kits 130 keyed to human use or use with a specific pet breed. Alternately, a user may select a generic kit having capacity sufficient for most internment applications including a sufficient quantity of void-filling cushions 120 to accommodate such a range. Upon reading the teachings of this specification, those of ordinary skill in the art will now understand that, under appropriate circumstances, considering such issues as intended use, user preference, nature of interned cremated remains, etc., other kit arrangements, such as, for example, providing multiple flexible storage containers, each comprising a unique size, the inclusion of alternate accessories such as articles of clothing, attachable indicia identifying a specific individual or pet, etc., may suffice.

Figure 6:
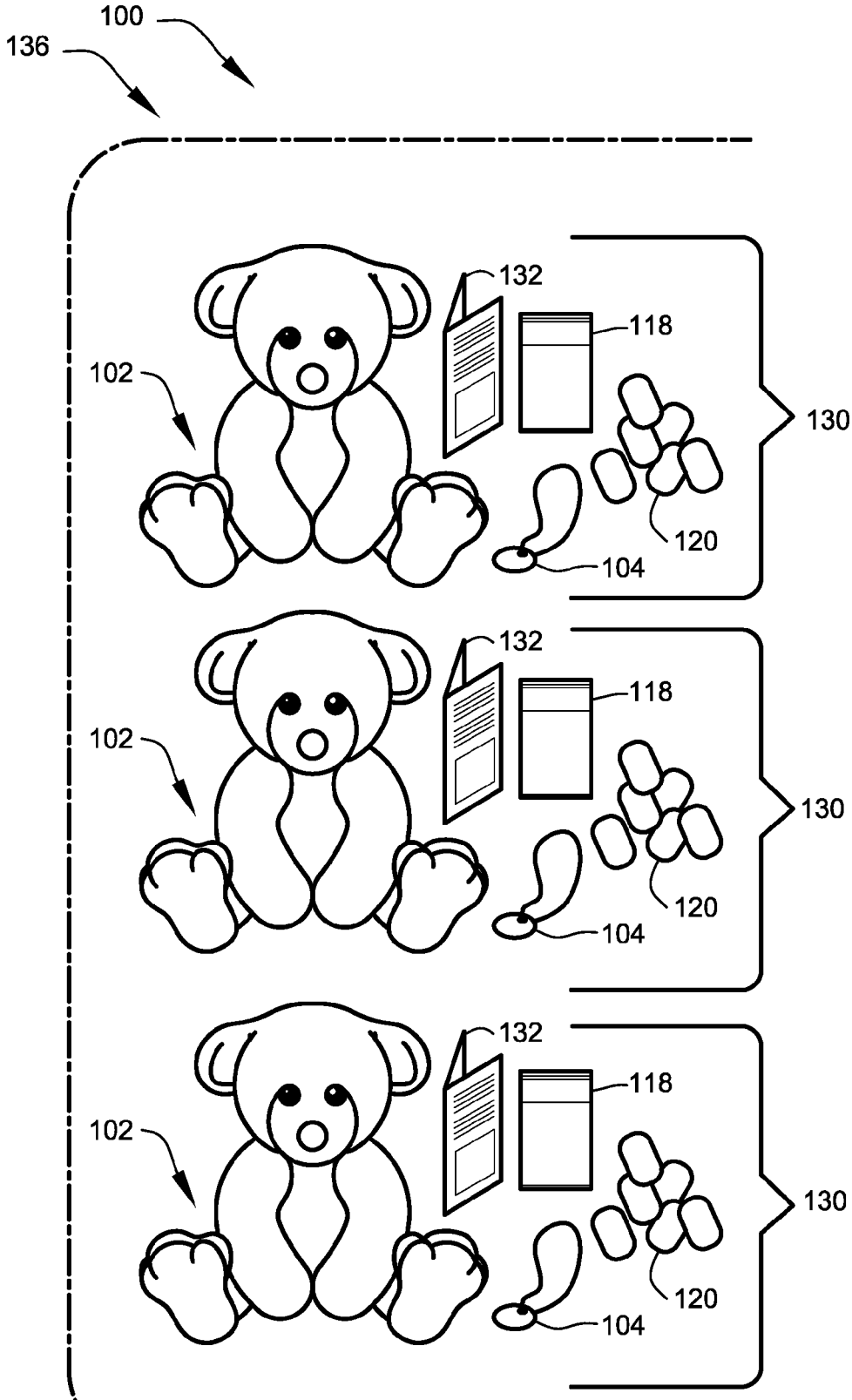
FIG. 6 shows a diagrammatic representation illustrating a kit of the huggable cremated remains storage system, comprising multiple soft cremated remains holders, according to another preferred embodiment of the present invention.

FIG. 6 shows a diagrammatic representation illustrating kit 136 of huggable cremated remains storage system 100, comprising multiple kits 130, according to another preferred embodiment of the present invention. Kit 136 is preferably provided as a means for dividing cremated remains 126 between several soft cremated-remains holders 102, as shown. Most preferably, kit 136 comprises two or more complete embodiments of kit 130, as shown. Preferably, each kit 130 of kit 136 is adapted to hold a divided portion of cremated remains 126. Kit 136 is especially suited for the sharing of cremated remains, belonging to a single individual, between multiple family members.

Preferably, each kit 130 of kit 136 is of substantially similar composition. Such uniformity of composition preferably extends to substantially the entire contents of the kid including soft cremated-remains holder 102 (and charm 104, as applicable). Alternately, preferred embodiments of kit 136 comprise a plurality of uniquely designed soft cremated-remains holders 102 and or charms 104. In such a preferred arrangement, each individual recipient is preferably provided the opportunity to custom-select a soft cremated-remains holder 102 of unique design and character, in response to individual taste or as an expression of the individual's unique association with the deceased. In such a preferred arrangement, individual recipients may preferably select from an available line of kit components with the selected components assembled by a supplier to form kit 136.

Figure 7:
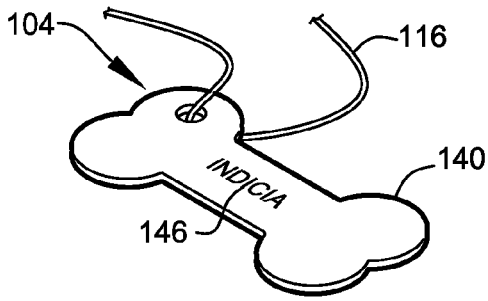
FIG. 7 shows a perspective view illustrating a bone-shaped jewelry item according to another preferred embodiment of the present invention.
Figure 8:
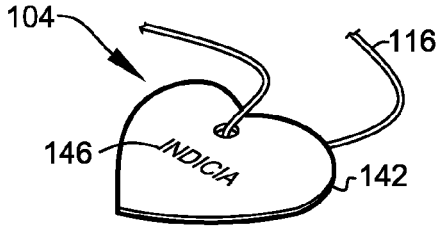
FIG. 8 shows a perspective view illustrating a heart-shaped jewelry item according to another preferred embodiment of the present invention.
Figure 9:
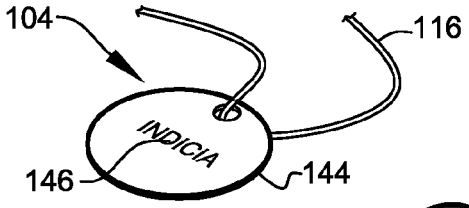
FIG. 9 shows a perspective view illustrating a disk-shaped jewelry item according to another preferred embodiment of the present invention.

In addition, preferred embodiments of kit 136 comprise versions of the above-described system components (including soft cremated-remains holder 102) of relatively smaller physical size, enabled by the diminished volume of cremated remains 126 interned within each secondary kit 130. Upon reading the teachings of this specification, those of ordinary skill in the art will now understand that, under appropriate circumstances, considering such issues as intended use, number of recipients of the cremated remains, etc., other kit arrangements, such as, for example, utilizing alternate soft cremated-remains holder shapes, such as plush pillows, plush bags, etc., may suffice. FIG. 7 shows a perspective view illustrating charm 104 comprising bone-shaped jewelry item 140 according to another preferred embodiment of the present invention. FIG. 8 shows a perspective view illustrating a second preferred example of charm 104 comprising heart-shaped jewelry item 142 according to another preferred embodiment of the present invention. FIG. 9 shows a perspective view illustrating a third preferred example of charm 104 comprising disk-shaped jewelry item 144 according to another preferred embodiment of the present invention. Preferably, the jewelry item embodiments of FIG. 7 through FIG. 9 enhances the personalization of huggable cremated remains storage system 100 by providing an attachable necklace comprising a "charm" or nameplate that can be personalized by the end customer/user. Preferably, disk-shaped jewelry item 144, heart-shaped jewelry item 142, and bone-shaped jewelry item 140 each comprise a displayable face for receiving custom indicia 146, as shown. In a highly preferred embodiment, indicia 146 comprise engraved letters visibly displayed on an external face of the jewelry item. Thus, the recipient is preferably afforded a means for personalizing huggable cremated remains storage system 100 with a meaningful name, word, or phrase.

Preferably, each jewelry item comprises at least one attachment feature adapted to assist in attaching the jewelry item to soft cremated-remains holder 102. More preferably, each jewelry item comprises a necklace-type cable or line, most preferably comprising the depicted chain portion 116. Preferably, chain portion 116 is of sufficient length to suspend the jewelry item in a visible position while extending around head portion 105 and through accessory loops 114, as previously illustrated FIG. 2. Upon reading the teachings of this specification, those of ordinary skill in the art will now understand that, under appropriate circumstances, considering such issues as user preference, design of jewelry item, etc., other attachment arrangements, such as, for example, pins, clips, hook-and-loop fasteners, belts, elastic bands, etc., may suffice.

Preferably, disk-shaped jewelry item 144 is included as a standard component of kit 130. Preferably, heart-shaped jewelry item 142 and bone-shaped jewelry item 140 are representative of jewelry items that may be selected as optional upgrades to the basic kit 130, as described above. Upon reading the teachings of this specification, those of ordinary skill in the art will now understand that, under appropriate circumstances, considering such issues as user preference, cost, etc., other jewelry item embodiments, such as charms adapted to hold photographic images, jewelry items comprising personal memorabilia of the deceased, jewelry items containing precious stones, etc., may suffice. Preferred jewelry items suitable for use with the present invention are available through a number of commercial sources including Internet suppliers such as those at the Internet sites www.stickyj.com and www.lindeburg.com.

Figure 10:
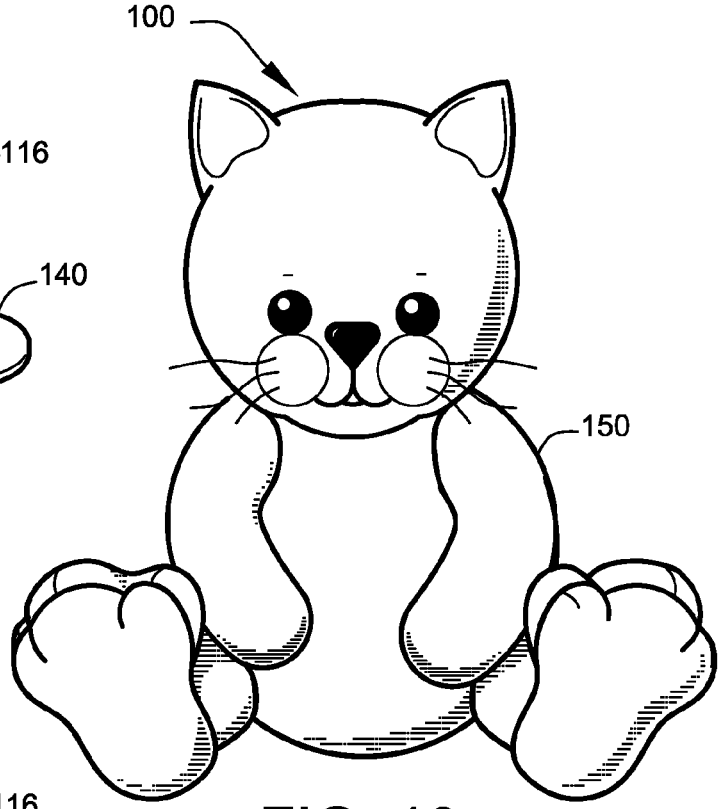
FIG. 10 shows a front view illustrating a cat-shaped soft cremated remains holder, of the huggable cremated remains storage system, according to another preferred embodiment of the present invention.
Figure 11:
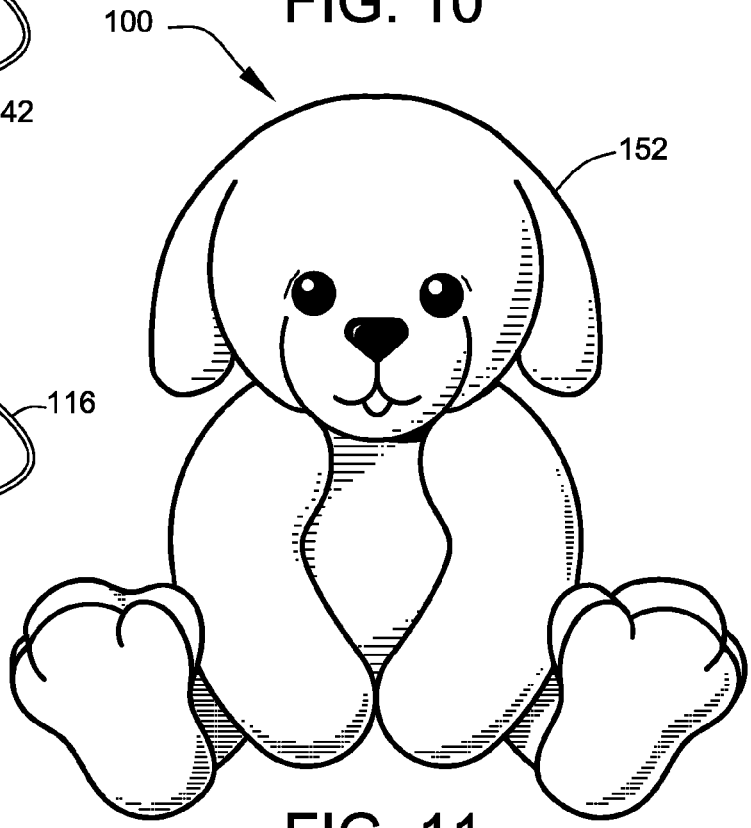
FIG. 11 shows a front view illustrating a dog-shaped soft cremated remains holder, of the huggable cremated remains storage system, according to another preferred embodiment of the present invention.

FIG. 10 shows a front view illustrating cat-shaped soft cremated remains holder 150, of huggable cremated remains storage system 100, according to another preferred embodiment of the present invention. Preferably, embodiments of huggable cremated remains storage system 100 provided for the internment of cremated pet remains comprise soft cremated remains holders generally matching the species of the deceased pet. For example, cat-shape soft cremated remains holder 150 is constructed with features resembling a cat (preferably including animals classified within Family Felidae). Preferred embodiments of the present invention provide unique identifying cues by comprising physical attributes associated with specific pet breeds (Persian, Siamese, etc.). Similarly, FIG. 11 shows a front view illustrating dog-shaped soft cremated remains holder 152, of huggable cremated remains storage system 100, according to another preferred embodiment of the present invention. Dog-shaped soft cremated remains holder 152 is structured and arranged to resemble a dog, more preferably, a specific dog breed within Family Canidae, as shown. Breed specific identifiers preferably include ear shape, body shape, fabric coloration, length/texture of synthetic fur, and similar design elements associated with a pet breed. Upon reading the teachings of this specification, those of ordinary skill in the art will now understand that, under appropriate circumstances, considering such issues as user preference, type of pet, etc., other soft cremated-remains holder arrangements adapted to resemble other animal species, such as birds, fish, rodents, reptiles, etc., may suffice.

Figure 12:
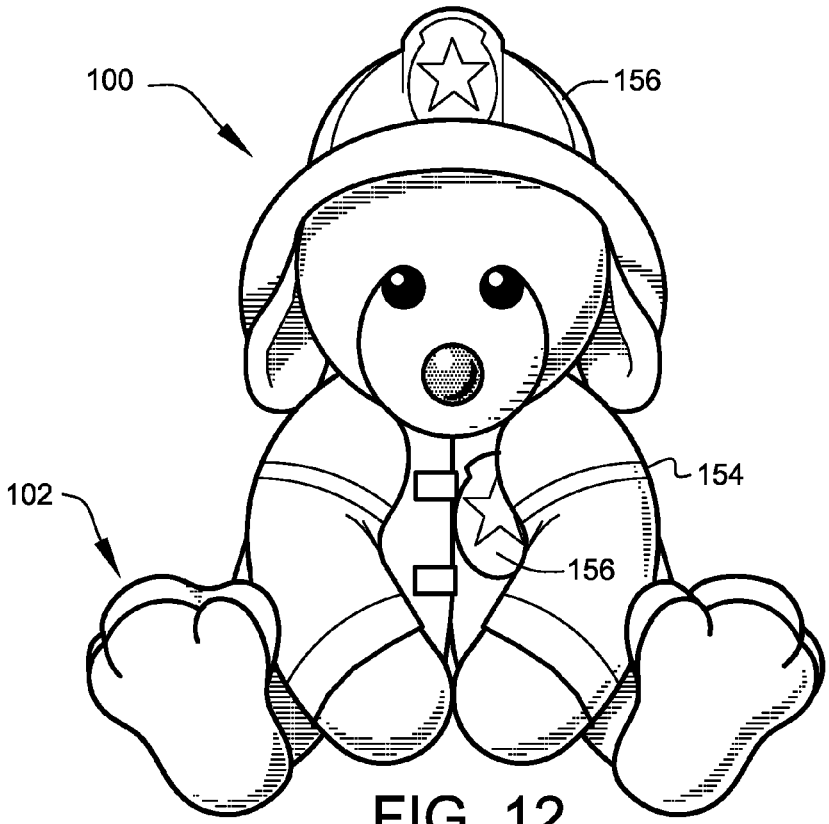
FIG. 12 shows a front view illustrating a soft cremated remains holder, of the huggable cremated remains storage system, comprising accessories associated with a specific vocation according to another preferred embodiment of the present invention.

FIG. 12 shows a front view illustrating soft cremated remains holder 102, of huggable cremated remains storage system 100, comprising accessories associated with a specific vocation according to another preferred embodiment of the present invention. Preferred embodiments of huggable cremated remains storage system 100 comprise external accessories adapted to associate soft cremated remains holder 102 with a specific vocation, profession, or career. Preferably, such external accessories comprise vocational clothing items 154 and vocational accessories 156, as shown (at least embodying herein wherein such at least one cushioned housing comprises at least one vocation symbol to ornamentally symbolize at least one human vocation). In the preferred example embodiment of FIG. 12, vocational clothing items 154 comprises a firefighter's coat with vocational accessories 156 comprising a firefighter's badge and firefighter's helmet, as shown. Both the vocational clothing item 154 and vocational accessories 156 function as symbolic representations identifying the vocation of the deceased individual interned within huggable cremated remains storage system 100. Upon reading the teachings of this specification, those of ordinary skill in the art will now understand that, under appropriate circumstances, considering the specific vocation/profession of the interned individual, etc., alternate clothing and accessory arrangements symbolizing other vocations, such as police officer, doctor, nurse, scientist, engineer, teacher, etc., may suffice.

Figure 13:
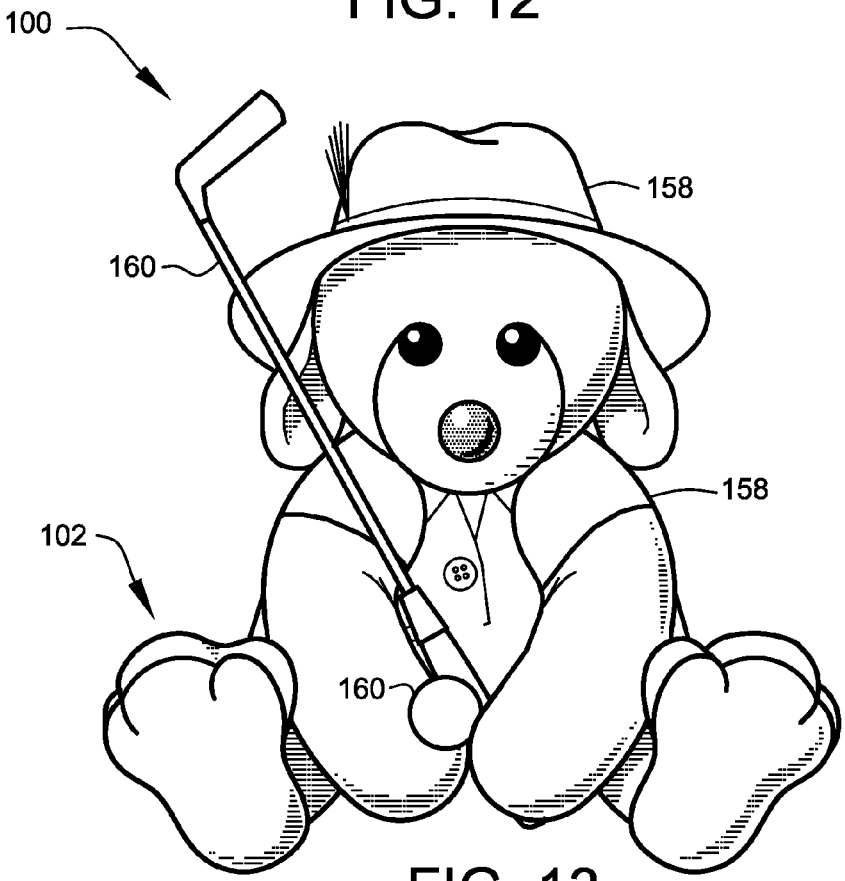
FIG. 13 shows a front view illustrating a soft cremated remains holder, of the huggable cremated remains storage system, comprising accessories associated with a specific avocation according to another preferred embodiment of the present invention.

FIG. 13 shows a front view illustrating soft cremated remains holder 102, of huggable cremated remains storage system 100, comprising accessories associated with a specific avocation according to another preferred embodiment of the present invention. Preferred embodiments of huggable cremated remains storage system 100 comprise external accessories adapted to associate soft cremated remains holder 102, and the interned in cremated remains 126 with a specific avocation, hobby, or similar recreational pastime.

Preferably, such external accessories comprise avocational clothing items 158 and avocational accessories 160, as shown (at least embodying herein wherein such at least one cushioned housing comprises at least one avocation symbol to ornamentally symbolize at least one human avocation). In the preferred example embodiment of FIG. 13, avocational clothing items 158 comprise a golfer's shirt and golfer's hat with avocational accessories 160 comprising a miniature golf club and golf ball, as shown. Both the avocational clothing items 158 and avocational accessories 160 function as symbolic representations identifying the avocation/hobby of the deceased individual interned within huggable cremated remains storage system 100. Upon reading the teachings of this specification, those of ordinary skill in the art will now understand that, under appropriate circumstances, considering the specific avocation/hobby of the interned individual, etc., alternate clothing and accessory arrangements symbolizing other avocations, such as tennis, physical fitness, bowling, fishing, camping, bicycling, motorcycling, etc., may suffice. Under appropriate circumstances, such clothing and accessory items may comprise licensed indicia associated specific companies, such as, for example, Harley Davidson Co., etc. Furthermore, those of ordinary skill in the art will now appreciate that, under appropriate circumstances, considering such issues as user preference, avocation of the deceased, etc., other recreational themes, such as depictions of a favored amateur or professional sports team, including, the supplying of helmets, jerseys, etc. comprising names and logos of National Football League, Major League Baseball, National Basketball Association, National Hockey League teams, etc., may suffice.

Figure 15:
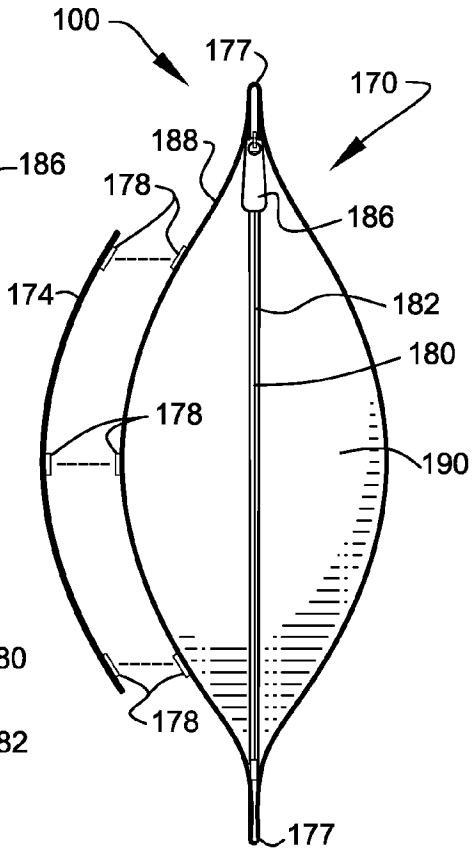
FIG. 15 shows a side view illustrating the pillow-shaped soft cremated remains holder, according to the preferred embodiment of FIG. 14.
Figure 14:
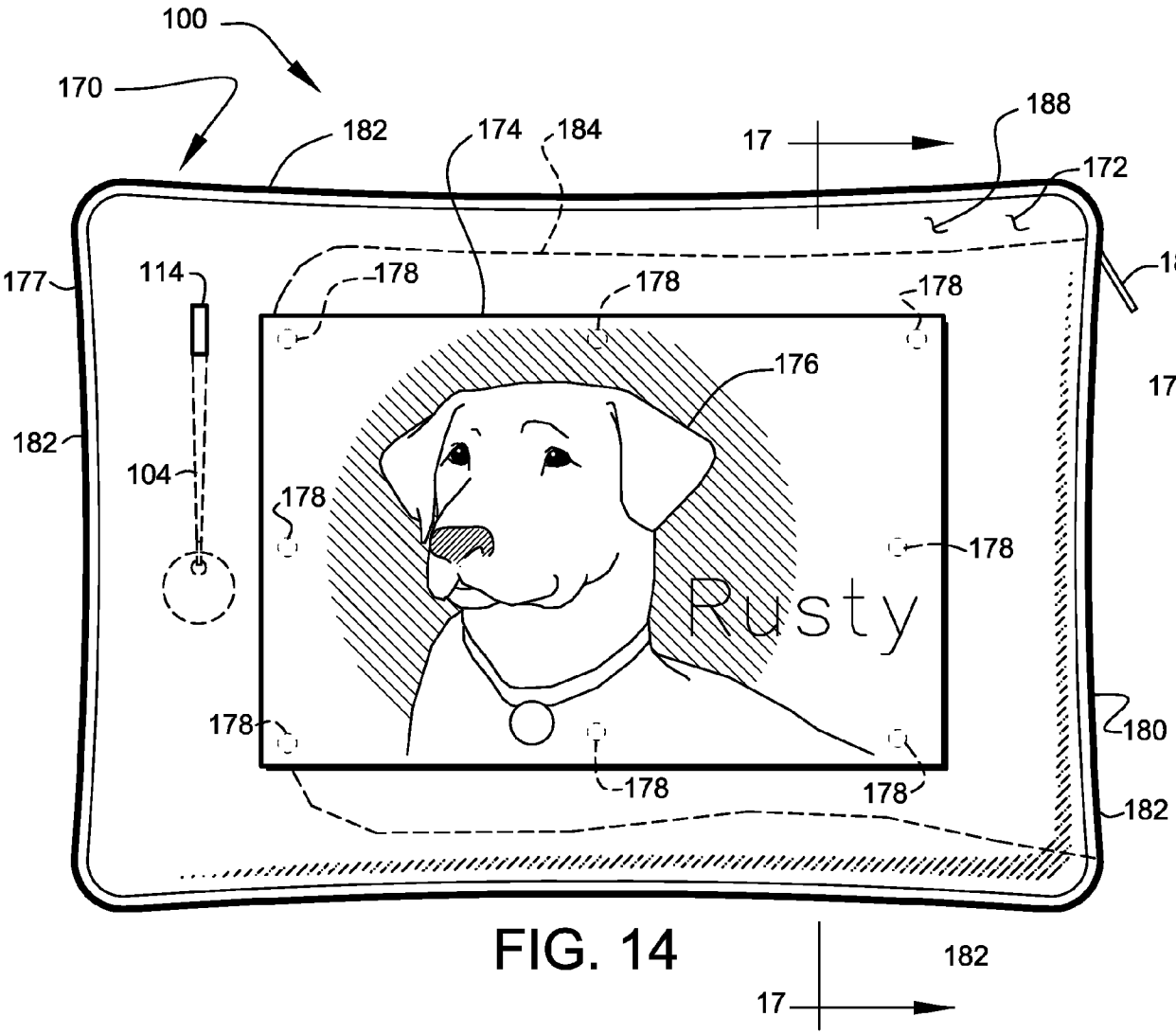
FIG. 14 shows a front view illustrating a pillow-shaped soft cremated remains holder, of the huggable cremated remains storage system, according to another preferred embodiment of the present invention.

FIG. 14 shows a front view illustrating pillow-shaped soft cremated remains holder 170, of huggable cremated remains storage system 100, according to another preferred embodiment of the present invention. FIG. 15 shows a side view illustrating pillow-shaped soft cremated remains holder 170, according to the preferred embodiment of FIG. 14. Pillow-shaped soft cremated remains holder 170 preferably comprises a cushioned holder similar in function and structure to the prior described embodiments. Preferably, pillow-shaped soft cremated remains holder 170 (at least embodying herein cushioned housing means for housing such container means, and at least embodying herein at least one cushioned housing) adapted to contain cremated remains 126, in an arrangement suitable for comfortable holding/grasping. Pillow-shaped soft cremated remains holder 170 (at least embodying herein wherein such at least one cushioned housing comprises at least one pillow) preferably comprises a generally generic geometric shape, differing from the prior described embodiments that preferably depict an abstraction of a living animal.

A unique and highly preferred feature of pillow-shaped soft cremated remains holder 170 comprises customizable graphic panel 174, as shown. Preferably, graphic panel 174 is initially removable from pillow body 176, as shown. Preferably, graphic panel 174 is adapted to support the application of graphic indicia 176, as further described in FIG. 20 (at least embodying herein wherein such at least one pillow comprises at least one graphic supporter adapted to support at least one graphic image). Preferably, graphic panel 174 comprises a substantially flexible graphic-receiving substrate having a substantially flat and planar surface. Preferably, graphic panel 174 comprises at least one sheet fabric material, with fabrics comprising 100% woven cotton fiber being most preferred. Preferably, graphic panel 174 is removably held to pillow-shaped soft cremated remains holder 170 by means of fasteners 178, as shown. Preferably, fasteners 178 are of a snap-type that comprise mechanically interlockable engagers of complementary pairs. Preferably, a first half of fastener 178 is affixed to the underside of graphic panel 174 while the second half is affixed to the flexible outer membrane 172 of pillow-shaped soft cremated remains holder 170, as shown. Preferably, a number of fasteners 178 are evenly distributed about the perimeter of graphic panel 174, as shown. In the depicted preferred example of FIG. 14, graphic panel 174 is retained using about eight fasteners 178, as shown (at least embodying herein at least one removable fastener adapted to removably fasten such at least one substantially flexible panel to such at least one substantially flexible outer membrane). Preferably, appropriate fastener quantities are selected based on graphic panel size/weight. Upon reading the teachings of this specification, those of ordinary skill in the art will now understand that, under appropriate circumstances, considering such issues as user preference, intended use, desired permanence of attachment, etc., other graphic panel to pillow fastening arrangements, such as lacing, buttons, hook-and-loop fasteners, bonding adhesives, etc., may suffice. The preferred initial removability of graphic panel 174 allows for user customization and personalization of pillow-shaped soft cremated remains holder 170, as further described in FIG. 20.

Figure 17:
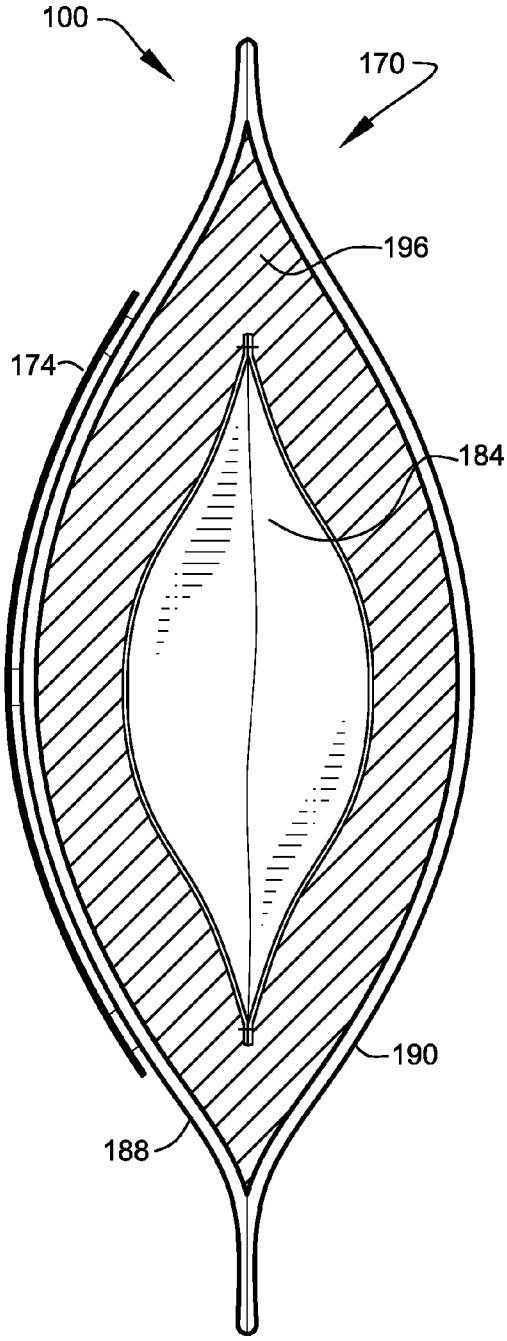
FIG. 17 shows a sectional view, through the section 17-17 of the FIG. 14, illustrating preferred interior arrangements of the soft cremated remains holder, according to the preferred embodiment of FIG. 14.

Preferably, pillow-shaped soft cremated remains holder 170 is constructed from a substantially flexible outer membrane 172 surrounding a resilient core material (see also FIG. 17). Preferably, flexible outer membrane 172 is constructed from at least one fabric, preferably a durable woven fabric material. Pillow-shaped soft cremated remains holder 170 is preferably assembled by mechanical seaming processes using an appropriately compatible thread. Upon reading the teachings of this specification, those of ordinary skill in the art will now understand that, under appropriate circumstances, considering such issues as pattern, fabric type, etc., other construction arrangements, such as, for example, the use of glues, chemical bonding agents, thermal/ultrasonic bonding, etc., may suffice.

Preferred embodiments of pillow-shaped soft cremated remains holder 170 are assembled using decorative edging, such as piping 177, as shown. Upon reading the teachings of this specification, those of ordinary skill in the art will now understand that, under appropriate circumstances, considering such issues as user preference, cost, etc., the use of other fabric constructions and assembly arrangements, such as quilting, embroidery, ruffling, fringing, tasseling, application of post-assembly decorations including dyes, paints, surface applications of sequins, rhinestones, etc., may suffice.

Preferably, pillow-shaped soft cremated remains holder 170 is further adapted to externally support additional personalizing accessories, most preferably charm 104, as shown. As in prior embodiments, charm 104 is retained adjacent pillow-shaped soft cremated remains holder 170 by means of an applied accessory loop 114, as shown. Preferably, accessory loop 114 comprises a flexible material, preferably a fabric ribbon, permanently joined to outer membrane 172, as shown.

The principal construction components of pillow-shaped soft cremated remains holder 170 comprises front fabric panel 188 joined to rear fabric panel 190 by a perimeter seaming process, as shown. Preferably, one side portion of pillow-shaped soft cremated remains holder 170 comprises access 180 (illustrated in a closed configuration), preferably located along perimeter seam 182, as shown. Preferably, access 180 comprises a slot or similar opening through which an interior pocket 184 is accessed (see FIG. 17). Preferably, interior pocket 184 is configured to form a compartment adapted to accept substantially the entire volume of cremated remains 126 (about 200 to 230 cubic inches for human cremated remains). As suggested previously, preferred embodiments of pillow-shaped soft cremated remains holder 170 include smaller pockets adapted to hold cremated remains of pets.

Preferably, access 180 comprises at least one closure means for closing and sealing access 180 to retain cremated remains 126 within interior pocket 184. In a highly preferred embodiment of the present invention, the closure means comprises zipper 186, as shown. Upon reading the teachings of this specification, those of ordinary skill in the art will now understand that, under appropriate circumstances, considering such issues as pillow design, weight of cremated remains, etc., other closure arrangements, such as, for example, lacing, hook-and-loop fasteners, flaps, elastic closures, draw strings, etc., may suffice.

Figure 16:
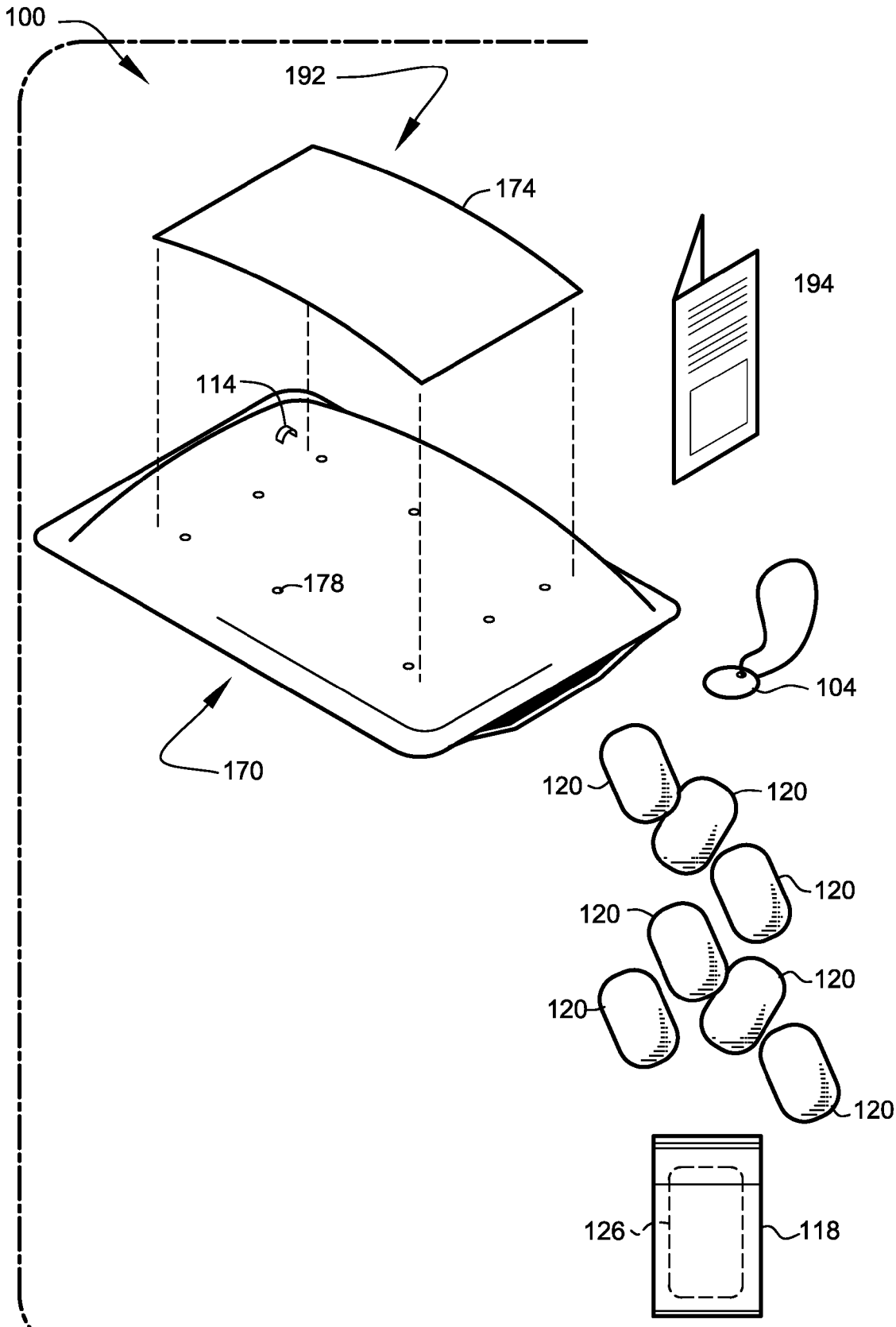
FIG. 16 shows a diagrammatic representation illustrating a kit comprising the pillow-shaped soft cremated remains holder, according to the preferred embodiment of FIG. 14.

FIG. 16 shows a diagrammatic representation illustrating kit 192 comprising pillow-shaped soft cremated remains holder 170, according to the preferred embodiment of FIG. 14. Preferred embodiments of huggable cremated remains storage system 100 are preferably arranged to comprise user-assembled kits, as shown. Preferably, example kit 192 comprises the essential components needed to intern cremated remains 126. These preferred components minimally comprise pillow-shaped soft cremated remains holder 170, graphic panel 174, flexible storage container 118, a quantity of void-filling cushions 120, and a set of user assembly instructions 194, as shown. In addition, preferred embodiments of kit 192 comprise an additional customizing accessory, preferably comprising charm 104, as shown. As previously indicated, the capacity of flexible storage container 118 as well as the number of void-filling cushions 120 are selected and supplied based on the quantity of cremated remains 126 to be interned. For example, a user may be assisted in selecting an appropriately configured kit by referring to a preestablished list of available kits 192 keyed to human use or use with regard to a specific pet breed. Alternately, a user may preferably select a generic kit having capacity sufficient for most internment applications including a sufficient quantity of void-filling cushions 120 to accommodate such an extended range. Upon reading the teachings of this specification, those of ordinary skill in the art will now understand that, under appropriate circumstances, considering such issues as intended use, user preference, nature of interned cremated remains, etc., other kit arrangements, such as, for example, providing multiple flexible storage containers, each comprising a unique size, etc., may suffice. Furthermore, it should be noted that alternate preferred embodiments of kit 136 of FIG. 6 comprise multiple aggregations of kit 192.

FIG. 17 shows a sectional view, through the section 17-17 of the FIG. 14, illustrating preferred interior arrangements of pillow-shaped soft cremated remains holder 170, according to the preferred embodiment of FIG. 14. Preferably, front fabric panel 188 and rear fabric panel 190 are produced from physical or electronic patterns using appropriate textile manufacturing methods. Resilient core 196 preferably comprises a lightweight synthetic fiber filling, preferably a commercially available filling material, with polyester fill (marketed under the name fiberfill) being most preferred. Preferably, front fabric panel 188 and rear fabric panel 190 are mechanically sewn to permanently encapsulate resilient core 196, as shown (at least embodying herein wherein such at least one pillow comprises at least one substantially flexible outer membrane substantially enclosing at least one substantially resilient filling material). Upon reading the teachings of this specification, those of ordinary skill in the art will now understand that, under appropriate circumstances, considering such issues as intended use, cost, etc., other fill arrangements, such as, for example, resilient expanded foams, synthetic or natural pellets, molded resilient foams, etc., may suffice.

Figure 18:
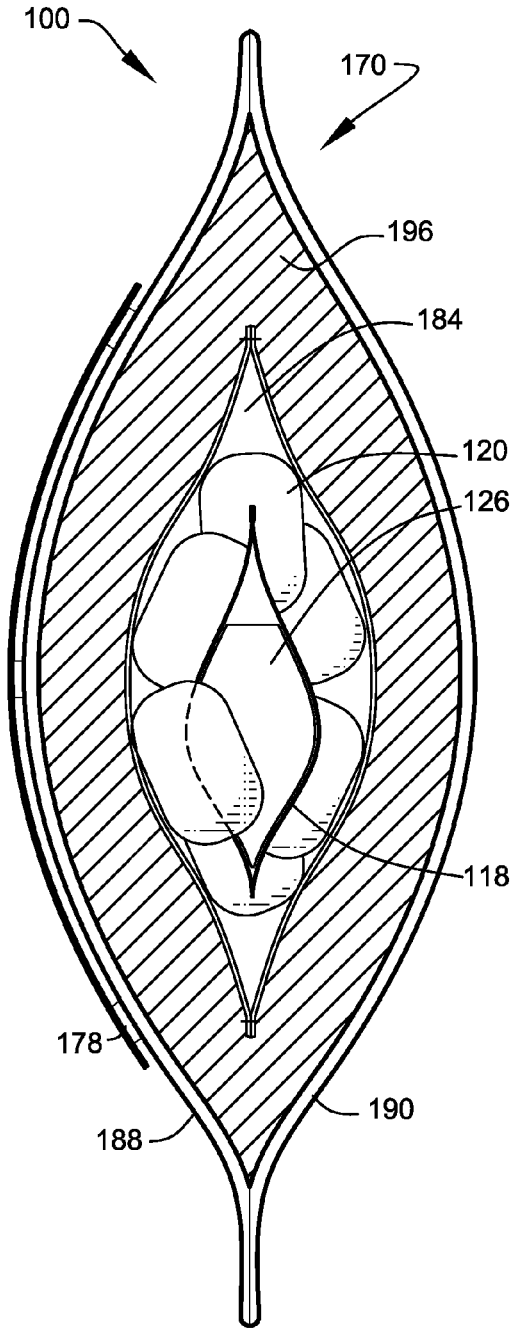
FIG. 18 shows a sectional view, through the section 17-17 of the FIG. 14, illustrating preferred interior component arrangements of the soft cremated remains holder, according to the preferred embodiment of FIG. 14.

FIG. 18 shows a sectional view, through the section 17-17 of the FIG. 14, illustrating preferred interior component arrangements of pillow-shaped soft cremated remains holder 170, according to the preferred embodiment of FIG. 14. Preferably, cremated remains 126 are protectively held in a soft enveloping layer of void-filling cushions 120, as shown. Preferably, interior pocket 184 is accessed through access 180 by positioning zipper 186 in an open configuration. Preferably, pocket 184 comprises a substantially continuous flexible compartment formed within the interior of pillow-shaped soft cremated remains holder 170, as shown. Preferably, interior pocket 184 comprises at least one woven fabric material. Preferably, the peripheral opening of interior pocket 184 is joined to the interior side of access 180, preferably by mechanical sewing to front fabric panel 188 and rear fabric panel 190. Upon reading the teachings of this specification, those of ordinary skill in the art will now understand that, under appropriate circumstances, considering such issues as preferred design, preference of patternmaking, etc., other construction arrangements, such as, for example, forming the interior pocket and outer panels from a continuous fabric sheet, combining the function of the flexible storage container with the pocket alone, including within the pocket additional restraining features to restrain or position the flexible storage container within the pocket, etc., may suffice. Preferably, assemblage of the interior components is undertaken by the user and is preferably based on user preference, volume of cremated remains 126.

On installing cremated remains 126 and void-filling cushions 120 within interior pocket 184 (positioned and arranged to the preference and satisfaction of the user) access 180 is again sealed by closing zipper 186 (see FIG. 15). Pillow-shaped soft cremated remains holder 170 is thus adapted to be configured by the user to allow comfortable holding (hugging) and similar manual manipulation, even with substantially the entire volume of cremated remains 126 securely interned within interior pocket 184, as shown.

Figure 19:
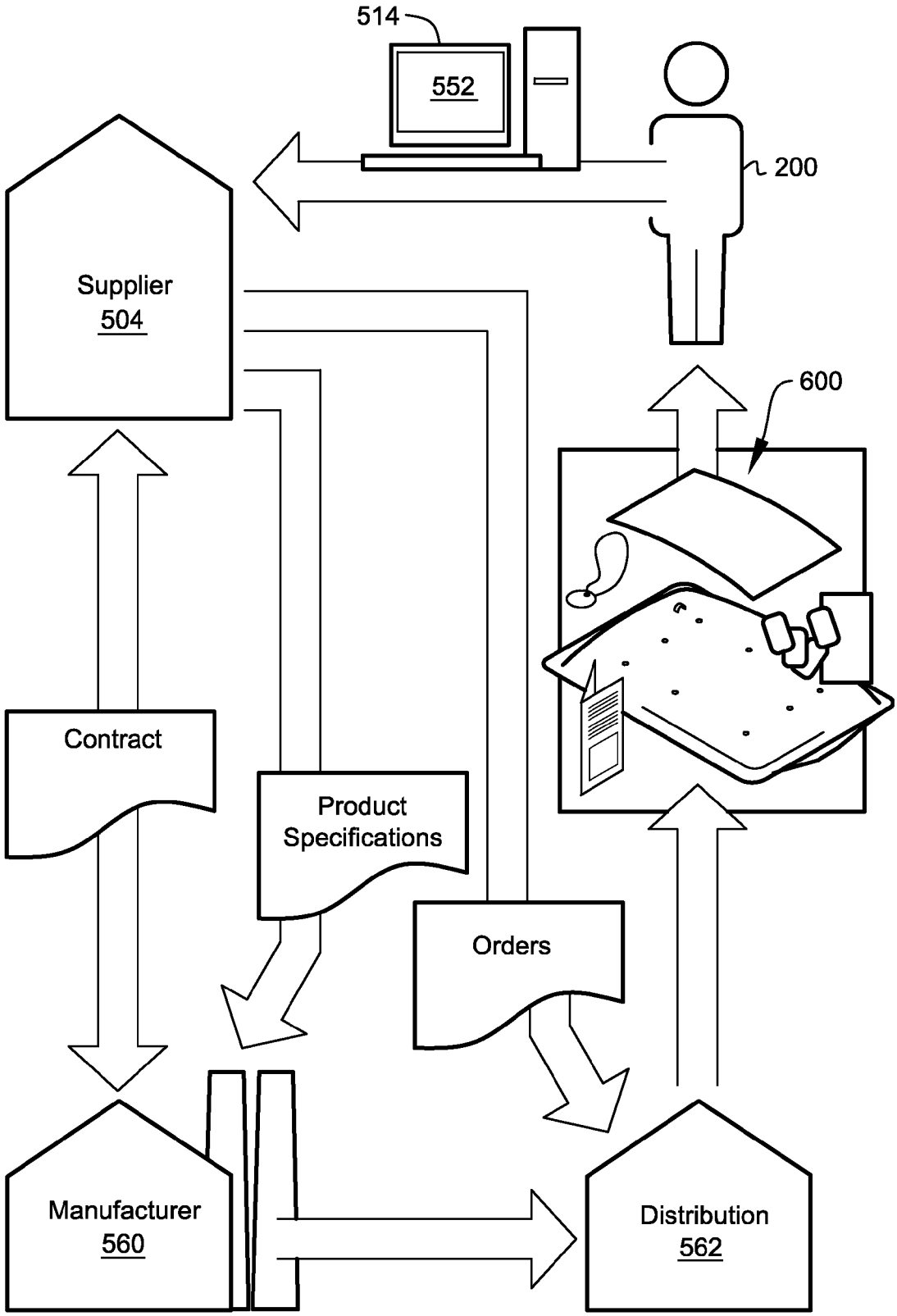
FIG. 19 illustrates diagrammatically a method of distributing the huggable cremated remains storage system according to another preferred embodiment of the present invention.

FIG. 19 shows a diagram, generally illustrating a method related to producing and distributing customizable cremated remains holder kit systems 600, according to another preferred embodiment of the present invention. Preferably, customizable cremated remains holder kit systems 600 comprises one of the above-described preferred kit embodiments of the present invention. In a preferred method, supplier 504 preferably operates one or more Internet website servers 514 offering to provide customizable cremated remains holder kit systems 600 for production and sale, as shown. Although Internet sales channels are most preferred, wholesale marketing channels utilizing on-site sales representatives are preferred in selected wholesale markets. These wholesale markets preferably include mortuaries and distributors within the memorialization industry as well as pet supply companies and veterinarians. Preferably, Internet website server 514 comprises a website adapted for the acceptance of orders and purchase transactions, from individuals 200, for customizable cremated remains holder kit systems. In the present disclosure, individual 200 preferably represents customers ranging from individual consumers to wholesale clients ordering quantities of kits. Preferably, the website is structured to permit individuals 200 to select and specify specific criteria for producing a single kit system or quantities of customizable cremated remains holder kit systems. For example, individual 200 preferably accesses Internet website server 514 and selects, from options menu 552, a customizable cremated remains holder kit systems including specifications for size, color, shape, type of charm, etc. Internet web site server 514 preferably provides to individual 200 instructions for user customization of customizable cremated remains holder kit systems 600. Individual 200 preferably completes the order by providing payment and shipping information. Upon reading the teachings of this specification, those of ordinary skill in the art will now understand that, under appropriate circumstances, considering such issues as customer preference, promotional marketing, etc., additional website-based content, such as, for example, permitting individuals to upload a photograph or image file for application on a graphic panel prior to shipping, offering emotional support via links to support groups, offering information on cremation, etc., may suffice.

Non-Internet sales preferably follow a substantially similar order process utilizing sales catalogs and execution of "paper" order contracts. Non-Internet sales channels similarly emphasize the conveying of user instructions as to methods of customizing customizable cremated remains holder kit systems 600. Upon reading the teachings of this specification, those of ordinary skill in the art will now understand that, under appropriate circumstances, considering such issues as nature of wholesale client, customer preference, etc., other hybrid sales arrangements, such as, for example, utilizing face-to-face sales representatives in conjunction with Internet ordering, etc., may suffice. Preferably, supplier 504 arranges for production of customizable cremated remains holder kit systems 600, using the order data provided by individual 200.

Manufacturing and delivery of orders for customizable cremated remains holder kit systems 600 follows at least two preferred methodologies. In the first preferred method, supplier 504 enters into a contract with manufacture of 560 to produce a ready supply of kit components, as shown. Preferably, manufactured components are delivered to a distribution site 562 where the components are stored in preparation for kit assembly. On receiving a custom order from individual 200, supplier 504 transmits the details of such orders to distribution site 562 where an appropriately configured kit is assembled and prepared for shipment.

In a second preferred method, supplier 504 enters into a contract with manufacture 560 to manufacture and assemble customizable cremated remains holder kit systems 600 utilizing a combined manufacturing and kit assembly arrangement, as shown. Under this preferred arrangement, supplier 504 transmits the details of the customer orders directly to manufacture 560 who manufactures and assembles kits matching the customer orders. In this preferred arrangement, little if any stock is warehoused in the manufacturing and delivery chain as a necessity of production and delivery. Preferably, the pre-preassembled kits are delivered to distribution site 562 in a form that is substantially ready to ship.

In a final preferred step applicable to both above-described manufacturing methods, supplier 504 provides for the shipping of customizable cremated remains holder kit systems 600 to individual 200, thus completing the transaction. Thus, it is seen that the above steps embody and provide herein a method relating to providing for the manufacture of customizable cremated remains holder kit systems comprising at least one customizable cremated remains holder comprising the steps of, offering for sell such customizable cremated remains holder kit systems; accepting at least one order for such customizable cremated remains holder kit systems; providing for acceptance of orders and payment from at least one individual for such customizable cremated remains holder kit systems; providing for shipping such ordered customizable cremated remains holder kit systems to such at least one individual; and providing at least one instruction set instructing at least one method of customizing such at least one customizable cremated remains holder. Furthermore, the above-described methods embody herein wherein such step of offering is performed through at least one site comprising an Internet site operated in conjunction with at least one website server.

Figure 20:
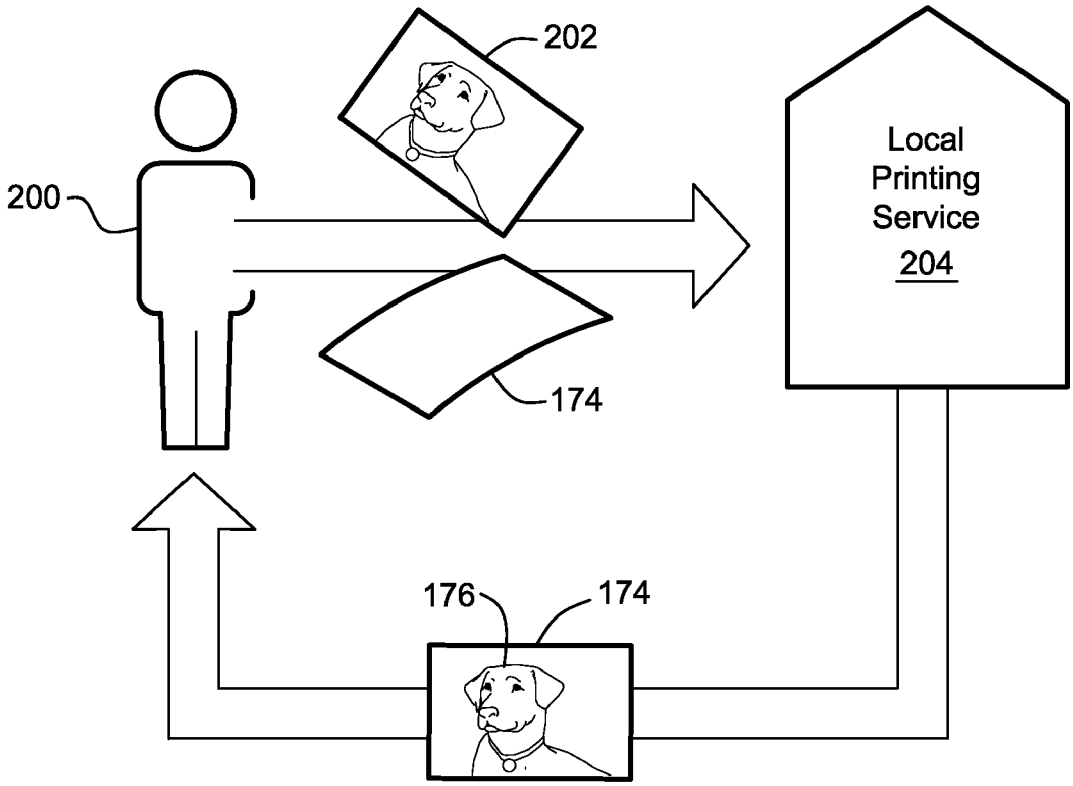
FIG. 20 illustrates diagrammatically another method of customizing the huggable cremated remains storage system according to another preferred embodiment of the present invention.

FIG. 20 illustrates diagrammatically another method of customizing the huggable cremated remains storage system according to another preferred embodiment of the present invention. Preferably, individual 200 acquires graphic panel 174 as a component of pillow-shaped soft cremated remains holder 170 (see FIG. 14) or as a component of kit 192 (see FIG. 16). Preferably, individual 200 selects an appropriate graphic image 202 to be applied to graphic panel 174. In the preferred example embodiment of FIG. 14, the selected graphic image 202 used to produce graphic indicia 176 comprises a photographic image of a pet. Preferably, individual 200 conveys the selected graphic image 202 and graphic panel 174 to a local printing service 204, as shown. Preferably, local printing service 204 provides a photo-image transfer service that can be used to transfer the selected graphic image 202 to graphic panel 174. In a preferred process, the image transfer medium comprises a heat sensitive transfer sheet (also referred to as in an iron-on transfer). In an alternate preferred process, the image transfer takes place as a direct application using an applied dye process. Preferably, local printing service 204 scans the selected graphic image 202 to produce a digital file. Local printing service 204 may also provide additional services such as graphic enhancements including the application of the individual's/pet's name to the graphic, etc. Preferably, printing service 204 applies the selected graphic image 202 to graphic panel 174 to form graphic indicia 176.

In the final preferred step, individual 200 reapplies graphic panel 174 containing graphic indicia 176 to pillow-shaped soft cremated remains holder 170. Upon reading the teachings of this specification, those of ordinary skill in the art will now understand that, under appropriate circumstances, considering such issues as user preference, intended use, etc., other methods of applying graphic indicia to the graphic panel, such as providing within a soft cremated remains holder kit, a quantity of heat sensitive printable transfer papers suitable for use in conjunction with the users home computer/printer, etc., may suffice. Furthermore, those of ordinary skill in the art will now understand that, under appropriate circumstances, considering such issues as user preference, intended use, etc., other delivery methods, such as offering through an Internet based web site a facility allowing the user to upload graphic data that is subsequently use to preprint a graphic panel prior to shipping, etc., may suffice.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A system for holding cremated remains comprising:

a) at least one cremated remains container adapted to contain the cremated remains;

b) at least one cushioned housing which houses said at least one cremated remains container;

c) at least one pocket which holds said at least one cremated remains container within said at least one cushioned housing;

d) at least one closure which closes said at least one pocket; and e) at least one void filler which fills at least one void surrounding said at least one container within said at least one pocket;

f) wherein said at least one void filler comprises at least one cushioner which cushions said at least one cremated remains container while held within said at least one pocket;

g) wherein said at least one cushioned housing comprises at least one pillow; and h) wherein said at least one pillow comprises at least one substantially flexible outer membrane substantially enclosing at least one substantially resilient filling material.

2. The system according to claim 1 wherein said at least one cushioned housing comprises at least one ornamental symbol adapted to ornamentally symbolize at least one characteristic of at least one entity associated with the cremated remains.

3. The system according to claim 1 wherein said at least one cushioned housing comprises at least one animal shape.

4. The system according to claim 3 wherein said at least one animal shape comprises at least one depiction substantially resembling animals classified within Family Ursidae.

5. The system according to claim 3 wherein said at least one animal shape comprises at least one depiction substantially resembling animals classified within Family Canidae.

6. The system according to claim 3 wherein said at least one animal shape comprises at least one depiction substantially resembling animals classified within Family Felidae.

7. The system according to claim 1 wherein said at least one cushioned housing comprises at least one vocation symbol to ornamentally symbolize at least one human vocation.

8. The system according to claim 7 wherein said at least one vocation symbol comprises at least one wearable article applied to said at least one cushioned housing.

9. The system according to claim 1 wherein said at least one cushioned housing comprises at least one avocation symbol to ornamentally symbolize at least one human avocation.

10. The system according to claim 9 wherein said at least one avocation symbol comprises at least one wearable article applied to said at least one cushioned housing.

11. The system according to claim 1 wherein said at least one pillow comprises at least one graphic supporter adapted to support at least one graphic image.

12. The system according to claim 11 wherein said at least one graphic supporter comprises at least one substantially flexible panel.

13. The system according to claim 12 wherein said at least one substantially flexible panel comprises at least one removable fastener which removably fastens said at least one substantially flexible panel to said at least one substantially flexible outer membrane.

14. The system according to claim 12 wherein said at least one substantially flexible panel comprises at least one fabric.

15. The system according to claim 1 further comprising at least one jewelry retainer adapted to retain at least one jewelry item adjacent to said at least one cushioned housing.

16. The system according to claim 1 wherein said at least one cushioned housing comprises at least one vocation symbol to ornamentally symbolize at least one human vocation; and wherein said system further comprises at least one jewelry item.

17. The system according to claim 16 wherein said at least one jewelry item comprises at least one disk-shaped portion.

18. The system according to claim 16 wherein said at least one jewelry item comprises at least one heart-shaped portion.

19. The system according to claim 16 wherein said at least one jewelry item comprises at least one bone-shaped portion.

20. The system according to claim 1 wherein said at least one closure comprises at least one zipper.

21. A kit system for holding cremated remains comprising:

a) at least one cremated remains container adapted to contain the cremated remains;

b) at least one pillow comprising i) at least one substantially flexible outer membrane substantially enclosing at least one substantially resilient filling material, ii) at least one pocket adapted to hold said at least one cremated remains container within said at least one pillow, and iii) at least one closure adapted to close said at least one pocket;

c) at least one void filler adapted to fill at least one void surrounding said at least one cremated remains container within said at least one pocket wherein said at least one void filler comprises at least one cushioner adapted to cushion said at least one cremated remains container while held within said at least one pocket;

d) at least one graphic supporter adapted to support at least one graphic image; and e) at least one set of user instructions adapted to provide at least one instruction related to the application of said at least one graphic image to said at least one graphic supporter;

f) wherein said at least one graphic supporter comprises at least one substantially flexible panel comprising at least one removable fastener adapted to removably fasten said at least one substantially flexible panel to said at least one substantially flexible outer membrane.

22. The kit system according to claim 21 further comprising at least one jewelry item.

23. A method of customizing cremated remains holders, comprising the steps of:

a) providing for the manufacture of customizable cremated remains holder kit systems comprising: at least one cremated remains container adapted to contain cremated remains; at least one cushioned housing which houses said at least one cremated remains container; at least one pocket which holds said at least one cremated remains container within said at least one cushioned housing; at least one void filler which fills at least one void surrounding said at least one container within said at least one pocket; wherein said at least one void filler comprises at least one cushioner which cushions said at least one cremated remains container while held within said at least one pocket; wherein said at least one cushioned housing comprises at least one pillow; and wherein said at least one pillow comprises at least one substantially flexible outer membrane substantially enclosing at least one substantially resilient filling material;

b) offering for sale said customizable cremated remains holder kit systems;

c) accepting at least one custom order for said customizable cremated remains holder kit systems;

d) providing for acceptance of orders and payment from at least one individual for said customizable cremated remains holder kit systems;

e) providing for shipping said ordered customizable cremated remains holder kit systems to said at least one individual; and f) providing at least one instruction set instructing at least one method of customizing said at least one customizable cremated remains holder kit systems.

24. The method according to claim 23 wherein said step of offering is performed through at least one site comprising an Internet site operated in conjunction with at least one website server.

25. A method of holding cremated remains comprising the steps of:

a) receiving at least one cremated remains holder comprising at least one removable graphics supporting panel;

b) removing said at least one removable graphics supporting panel;

c) imprinting said at least one removable graphics supporting panel with at least one graphic image; and d) installing said at least one removable graphics supporting panel on said at least one cremated remains holder;

e) wherein said at least one cremated remains holder comprises at least one substantially flexible outer membrane substantially enclosing at least one substantially resilient filling material.

* * * * *